US007017837B2

(12) United States Patent
Taketomi et al.

(10) Patent No.: US 7,017,837 B2
(45) Date of Patent: Mar. 28, 2006

(54) WATER DISCHARGE SWITCHING DEVICE

(75) Inventors: Youjirou Taketomi, Fukuoka (JP); Yasuhiro Takebayashi, Fukuoka (JP); Takafumi Miyagi, Fukuoka (JP)

(73) Assignee: Toto Ltd., Fukuoka (JP)

( * ) Notice: Subject to any disclaimer, the term of this patent is extended or adjusted under 35 U.S.C. 154(b) by 0 days.

(21) Appl. No.: 10/494,532

(22) PCT Filed: Nov. 5, 2002

(86) PCT No.: PCT/JP02/11484

§ 371 (c)(1),
(2), (4) Date: May 4, 2004

(87) PCT Pub. No.: WO03/040481

PCT Pub. Date: May 15, 2003

(65) Prior Publication Data

US 2005/0001064 A1 Jan. 6, 2005

(30) Foreign Application Priority Data

| | | |
|---|---|---|
| Nov. 9, 2001 | (JP) | 2001-345425 |
| Jun. 21, 2002 | (JP) | 2002-181147 |
| Jun. 21, 2002 | (JP) | 2002-181155 |
| Jun. 21, 2002 | (JP) | 2002-181919 |
| Jun. 21, 2002 | (JP) | 2002-182137 |

(51) Int. Cl.
*E03C 1/08* (2006.01)
*A62C 31/00* (2006.01)

(52) U.S. Cl. ..... 239/428.5; 239/436; 239/443

(58) Field of Classification Search ..... 239/428.5, 239/436, 443, 390, 391, 437, 438, 447, 449, 239/451–453, 456, 569, 575
See application file for complete search history.

(56) References Cited

U.S. PATENT DOCUMENTS

| | | | | |
|---|---|---|---|---|
| 3,884,418 | A * | 5/1975 | Ritzenthaler et al. | 239/428.5 |
| 5,143,295 | A | 9/1992 | Okayama et al. | |
| 5,348,231 | A * | 9/1994 | Arnold et al. | 239/428.5 |

FOREIGN PATENT DOCUMENTS

| | | |
|---|---|---|
| JP | 51-135 | 1/1976 |
| JP | 61-6560 | 1/1986 |
| JP | 4-211778 | 8/1992 |

* cited by examiner

*Primary Examiner*—David A. Scherbel
*Assistant Examiner*—Darren Gorman
(74) *Attorney, Agent, or Firm*—Wenderoth, Lind & Ponack, L.L.P.

(57) ABSTRACT

A water discharge switching device which is easily miniaturized, readily assembled, and manufactured at low cost and prevents leakage of water. The water discharge switching device includes a foaming water producing and discharging device having a water inlet (1*c*), an air/water mixing chamber facing the water inlet (1*c*) and capable of communicating with the water inlet (1*c*), an air suction port capable of communicating with the air/water mixing chamber, and a foaming water outlet. The switching device also includes a shower water discharging device having a shower water discharge port (2*d*) and capable of communicating with the water inlet (1*c*). The shower water discharging device is arranged around the air/water mixing chamber of the foaming water producing and discharging device. Also, water discharge switching device for selectively switching between the discharge of foaming water from the foaming water producing and discharging device and the discharge of shower water from the shower water discharging device. The shower water discharge port (2*d*) of the shower water discharging device forms the air suction port of the foaming water producing and discharging device.

21 Claims, 28 Drawing Sheets

(a)

(b)

When foaming water is discharged

When shower water is discharged

WATER DISCHARGE SWITCHING DEVICE

BACKGROUND OF THE INVENTION

1. Technical Field

The present invention relates to a water discharge switching device capable of switching a water discharge mode between the discharge of foaming water and the discharge of shower water.

2. Description of Related Art

A conventional water discharge switching device has been used including: a foaming water producing and discharging means having a water inlet, an air/water mixing chamber and capable of communicating with the water inlet, an air suction port capable of communicating with the air/water mixing chamber, and a foaming water outlet; shower water discharging means having a shower water discharge port and capable of communicating with the water inlet, the shower water discharging means being arranged around the air/water mixing chamber of the foaming water producing and discharging means; and water discharge switching means for selectively switching between the discharge of foaming water from the foaming water producing and discharging means and the discharge of shower water from the shower water discharging means.

However, in this conventional water discharge switching device, as the air suction port of the foaming water producing and discharging means and the shower water discharge port of the shower water discharging means are provided separately from each other, a problem is presented in that it is difficult to miniaturize the water discharge switching device. Further, other problems are also presented that since the constitution of the water discharge switching means is complicated, miniaturizing the device is difficult, assembling performance is poor, and manufacturing cost is high.

The present invention has been made in view of the above problems. An object of the present invention is to provide a water discharge switching device which can be easily miniaturized compared with the conventional water discharge switching device. Another object of the present invention is to provide a water discharge switching device in which water discharge switching means is simpler in construction, better in assembling performance and with lower manufacturing costs compared with the conventional water discharge switching device.

Still another object of the present invention is to provide a water discharge switching device which can prevent water from flowing back to an air suction port to leak from the shower water discharge port at the time when foaming water is discharged.

SUMMARY OF THE INVENTION

The first construction of a water discharge switching device in accordance with the present invention includes: foaming water producing and discharging means having a water inlet, an air/water mixing chamber facing the water inlet and capable of communicating with the water inlet, an air suction port capable of communicating with the air/water mixing chamber, and a foaming water outlet; shower water discharging means having a shower water discharge port and capable of communicating with the water inlet, the shower water discharging means being arranged around the air/water mixing chamber of the foaming water producing and discharging means; and water discharge switching means for selectively switching between the discharge of foaming water from the foaming water producing and discharging means and the discharge of shower water from the shower water discharging means, being characterized in that the shower water discharge port of the shower water discharging means forms the air suction port of the foaming water producing and discharging means, and that the water discharge switching means is means for opening and closing a communication passage between the air/water mixing chamber and the foaming water outlet of the foaming water producing and discharging means and is provided with flow adjusting means for adjusting a foaming water discharge flow and a shower water discharge flow.

In the first construction of a water discharge switching device in accordance with the present invention, in a case where water is discharged from the foaming water producing and discharging means, water flowing through the water inlet into the air/water mixing chamber, which is facing the water inlet, of the foaming water producing and discharging means is mixed with air sucked from the shower water discharge port of the shower water discharging means to become foaming water and is discharged from the foaming water outlet.

In a case where water is discharged from the shower water discharging means, water flowing through the water inlet into the shower water discharging means becomes shower water in the shape of a line and is discharged from the shower water discharge port. Since the shower water discharge port of the shower water discharging means forms the air suction port of the foaming water producing and discharging means, the water discharge switching device in accordance with the present invention is easily miniaturized as compared with a conventional water discharge switching device in which the shower water discharge port of the shower water discharging means is formed separately from the air suction port of the foaming water producing and discharging means.

When the communication passage between the air/water mixing chamber and the foaming water outlet of the foaming water producing and discharging means is opened, water flowing through the water inlet into the air/water mixing chamber, which is facing the water inlet, of the foaming water producing and discharging means becomes foaming water and can be discharged through the above-mentioned communication passage from the foaming water outlet. When the above-mentioned communication passage is closed, the water flowing through the water inlet into the air/water mixing chamber, which is facing the water inlet, of the foaming water producing and discharging means cannot be discharged from the foaming water outlet and thus flows into the shower water discharging means to be discharged from the shower water discharge port.

The above-mentioned communication passage can be opened and closed by a simple mechanism. As a result, the constitution of the water discharge switching means is simplified to make it possible to miniaturize a water discharge switching device, to improve the assembling performance of the water discharge switching device and to reduce the manufacturing cost of the water discharge switching device as compared with the conventional water discharge switching device.

In a preferable aspect of the first construction of the present invention, the above-mentioned flow adjusting means is means for adjusting a cross-sectional area of a communication passage between the air/water mixing chamber and the water inlet of the foaming water producing and discharging means and a cross-sectional area of a communication passage between the shower water discharge port of the shower water discharging means and the water inlet.

The foaming water discharge flow can be adjusted by adjusting the cross-sectional area of the communication passage between the air/water mixing chamber and the water inlet of the foaming water producing and discharging means, and the shower water discharge flow can be adjusted by adjusting the cross-sectional area of the communication passage between the shower water discharge port of the shower water discharging means and the water inlet.

In another preferable aspect of the first construction of the present invention, the shower water discharging means is relatively moved with respect to the air/water mixing chamber of the foaming water producing and discharging means, and thereby adjusting the cross-sectional area of the communication passage between the air/water mixing chamber and the water inlet of the foaming water producing and discharging means and the cross-sectional area of the communication passage between the shower water discharge port of the shower water discharging means and the water inlet.

A second construction of a water discharge switching device in accordance with the present invention is a water discharge switching device including: foaming water producing and discharging means having a water inlet, an air/water mixing chamber facing the water inlet and capable of communicating with the water inlet, an air suction port capable of communicating with the air/water mixing chamber, and a foaming water outlet; shower water discharging means having a shower water discharge port and capable of communicating with the water inlet, the shower water discharging means being arranged around the air/water mixing chamber of the foaming water producing and discharging means; and water discharge switching means for selectively switching between the discharge of foaming water from the foaming water producing and discharging means and the discharge of shower water from the shower water discharging means, in which the shower water discharge port of the shower water discharging means forms the air suction port of the foaming water producing and discharging means, the water discharge switching means is a means for opening and closing a communication passage between the air/water mixing chamber and the foaming water outlet of the foaming water producing and discharging means, and the shower water discharging means is relatively moved with respect to the air/water mixing chamber of the foaming water producing and discharging means so that the communication passage between the air/water mixing chamber and the foaming water outlet of the foaming water producing and discharging means is opened and closed, the water discharge switching device further including: a first cylindrical body having a partition wall for defining an inflow chamber and a discharge chamber which are adjacent to each other in the longitudinal direction, a pillar-shaped body extending from the partition wall to form the discharge chamber in an annular shape and having a flange-shaped valve seat formed at an end portion thereof, and a plurality of first small-diameter holes formed in the partition wall in a manner surrounding the pillar-shaped body near the pillar-shaped body; and a second cylindrical body having an inner cylinder and an outer cylinder which are concentrically arranged, an end wall for closing one end of a first annular gap formed between the inner cylinder and the outer cylinder, a plurality of second small-diameter holes formed in the end wall with a gap between them in a circumferential direction, and an annular valve body extending from an inner peripheral surface of the inner cylinder, the outer cylinder of the second cylindrical body being externally fitted on the first cylindrical body such that the outer cylinder can move relatively in a vertical direction with a fitting portion thereof being sealed, the inner cylinder of the second cylindrical body moving into the discharge chamber of the first cylindrical body outside in a radial direction of the first small-diameter hole to form a second annular gap between the inner cylinder and a peripheral wall of the first cylindrical body forming an outer peripheral wall of the discharge chamber and a third annular gap between the inner cylinder and the pillar-shaped body, and the annular valve body facing to the flange-shaped valve seat in the third annular gap.

In the second construction of the water discharge switching device in accordance with the present invention, when the annular valve body is separated from the flange-shaped valve seat, water passing through the first small-diameter holes flows into the third annular gap and air sucked from the second small-diameter holes flows through the second annular gap into the third annular gap. In the third annular gap, the water is mixed with the air to produce foaming water. The foaming water passes through a gap between the annular valve body and the flange-shaped valve seat, flows out of the third annular gap, reaches the end portion of the inner cylinder of the second cylindrical body and is discharged from the end portion.

When the second cylindrical body relatively moves in the vertical direction with respect to the first cylindrical body and the annular valve body abuts against the flange-shaped valve seat, water flowing through the first small-diameter holes into the third annular gap fills the third annular gap closed at its downstream end and flows over the third annular gap into the second annular gap. The water flowing into the second annular gap is discharged as a shower flow from the second small-diameter holes.

The second small-diameter holes function as the shower water discharge ports and as the air suction ports for producing foaming water, so that the water discharge switching device in accordance with the present invention is easily miniaturized as compared with the conventional water discharge switching device in which the shower water discharge ports are formed separately from the air suction ports for producing the foaming water.

A water discharge switching mechanism in which the second cylindrical body is relatively moved in the vertical direction with respect to the first cylindrical body to bring or separate the annular valve body into contact with or from the flange-shaped valve seat to switch between the discharge of the foaming water and the discharge of the shower water has a simple structure. Therefore, it is possible to miniaturize the water discharge switching device, to improve the assembling performance of the water discharge switching device and to reduce the manufacturing cost of the water discharge switching device, as compared with the conventional water discharge switching device.

In a preferable aspect of the second constitution of the present invention, a part of the outer cylinder of the second cylindrical body is screwed on a part of the first cylindrical body.

The second cylindrical body can be securely moved relatively in the vertical direction with respect to the first cylindrical body, and it is possible to securely switch a water discharge mode.

In another preferable aspect of the second construction of the present invention, a first screw portion which is a screw portion of a part of the flange-shaped valve seat and the partition wall of the first cylindrical body and a second screw portion which is a screw portion of a part of the outer cylinder of the second cylindrical body and a part of the first cylindrical body are concentrically arranged, and a turning direction when the first screw portion is fastened is opposite to a turning direction when the second screw portion is fastened.

The inner cylinder can be screwed in the first cylindrical body from inside. Moreover, by arranging the outer cylinder outside the first cylindrical body and connecting it to the inner cylinder, the second cylindrical body can be externally screwed on the first cylindrical body. That is, the second screw portion means a portion which is formed inside or outside the first cylindrical body at which an external thread is screwed in an internal thread.

When the second screw portion is turned in the direction of loosening, the inner cylinder moves downstream and the annular valve body abuts against the flange-shaped valve seat to close a first flow passage. Moreover, when the second screw portion is turned in the direction of fastening, the inner cylinder moves upstream and the annular valve body is separated from the flange-shaped valve seat to make the first flow passage communicate with a second flow passage.

The flange-shaped valve seat can be screwed in the partition wall and can also be passed through the partition wall and screwed in another member to fix the partition wall.

The flange-shaped valve seat is so fixed that it is fastened when it is screwed in an upstream direction, and in a state where fluid flows in the first flow passage, the flange-shaped valve seat receives a hydraulic force in a downstream direction and hence is brought into a state in which it is easily loosened.

However, when the second screw portion is turned in the direction for loosening, the annular valve body abuts against the flange-shaped valve seat to press the flange-shaped valve seat in the direction of flow and to apply force to the flange-shaped valve seat in a direction of fastening, so that the flange-shaped valve seat is fastened little by little every time the second screw portion is turned.

In still another preferable mode of the second construction of the present invention, a sealing member having elasticity and being watertight is provided on the side surface on the upstream side of the flange portion of the above-mentioned flange-shaped valve seat.

A high-molecular compound having elasticity such as natural rubber and synthetic rubber is preferable as the sealing member. The annular valve body abuts against the outer peripheral portion of the flange-shaped valve seat while moving spirally, so the sealing member is pressed downstream and receives force in a direction of turning.

As the sealing member has elasticity, the force for pressing the flange-shaped valve seat downstream is absorbed by the sealing member and thus the force to be applied to the second screw portion in an axial direction is reduced.

Still another preferable aspect of the second construction of the present invention is characterized in that the first cylindrical body is provided with a stopper against which the second cylindrical body is made to abut from the direction of flow, thereby being stopped, and that the first cylindrical body has a protrusion, over which the crest of a screw thread of the second cylindrical body can climb, on a bottom of a screw thread thereof.

It is preferable that the first cylindrical body and the second cylindrical body are made of hard resin, for example, ABS or the like, so as to prevent the screw thread from being broken when the crest of the screw thread climbs over the protrusion. By using the hard resin, when the crest of the screw thread climbs over the protrusion, the whole screw thread and protrusion are deformed to release a stress concentrated on the crest of the screw thread and the protrusion.

In a case where the second cylindrical body is provided outside the first cylindrical body, an internal thread is cut on the second cylindrical body and an external thread is cut on the first cylindrical body. Moreover, in a case where the second cylindrical body is provided inside the first cylindrical body, the external thread is cut on the second cylindrical body and the internal thread is cut on the first cylindrical body.

The cross-section of the protrusion can be formed in the shape of an arc, a triangle, or a rectangle, for example, but may be formed in another shape. Moreover, the cross section of the screw thread can be also formed in the same shape of an arc, a triangle, a rectangle, in accordance with the cross section of the protrusion, but may be formed in a shape different from that of the protrusion.

The stopper can be formed on a part of the first cylindrical body and may be formed of a member other than the first cylindrical body and this member may be mounted for use on the first cylindrical body.

The thread can be formed in a single thread, a double thread or a multiple thread. In a case where a thread of double or more is formed, in order to prevent a misalignment between the center of the second cylindrical body and the center of the first cylindrical body, it is preferable that the number of the protrusions is equal to the number of threads.

When the second cylindrical body is turned to the base side of the first cylindrical body screwed in the second cylindrical body, the crest of the screw thread of the second cylindrical body abuts against the protrusion. When the second cylindrical body is turned further, the crest of the screw thread climbs over the protrusion and the screw thread moves while sliding on the protrusion.

When the second cylindrical body is turned still further, at least a part, on the upstream side in the direction of flow, of the second cylindrical body abuts against the stopper and stops there.

A force necessary for operating the second cylindrical body is a small force resistant to a substantially constant frictional force caused by sliding until the second cylindrical body abuts against the protrusion, and is a large force for deforming the first cylindrical body and the second cylindrical body until the second cylindrical body that abutted against the protrusion climbs over it. Then, until the second cylindrical body abuts against the stopper, in order to slide the screw thread on the protrusion in a state where it climbs over the protrusion, a substantially constant force resistant to a large frictional force is required.

A user turns the second cylindrical body and recognizes that the second cylindrical body abuts against the protrusion by a change in frictional resistance and then applies a large force to the second cylindrical body. After the crest of the screw thread climbs over the protrusion, as the second cylindrical body is stopped by the stopper, the user quickly relaxes the force. The user memorizes, after several times of use, a turn angle of the second cylindrical body from the time when the screw thread abuts against the protrusion to the time when the second cylindrical body abuts against the stopper, so that it does not happen that the user tries to further turn the second cylindrical body after the second cylindrical body abuts against the stopper to break the device.

Even if a hydraulic pressure is applied to the second cylindrical body in a state where the second cylindrical body climbs over the protrusion, the frictional resistance between the screw thread of the second cylindrical body and the protrusion becomes large, so that the second cylindrical body does not move downstream.

It is preferable that a turn angle from the time when the screw thread abuts against the protrusion to the time when the second cylindrical body abuts against the stopper ranges from about 2° to 10°. This is because if this angle is too large, it is hard to memorize the turn angle and after the screw thread climbs the protrusion, it is necessary to further apply force to the second cylindrical body and to turn it, whereas if this angle is too small, the user makes the second cylindrical body abut against the stopper in a state where he/she applies force to the second cylindrical body to break the device.

If the above-mentioned screw thread is formed in the shape of a rectangle or a trapezoid in cross section, the crest of the screw thread is formed in the shape of a straight line to disperse a stress produced when the screw thread climbs over the protrusion.

The outer cylinder of the second cylindrical body is externally, slidably and tightly fitted on the first cylindrical body.

It is possible to securely relatively move the second cylindrical body in the vertical direction with respect to the first cylindrical body and thus securely switch a water discharge mode.

In still another preferable aspect of the second construction of the present invention, the first cylindrical body is provided with a non-threaded portion continuing to a notch of the first cylindrical body on an outer peripheral portion thereof.

By providing the non-threaded portion on the outer peripheral portion of the first cylindrical body at regular intervals, when the first cylindrical body is taken out of a metal die, it is possible to reduce trouble that the first cylindrical body is caught on the metal die. For this reason, it is possible to reduce the number of divisions of the metal die and thus to improve moldability. Further, by reducing metal die cost and time necessary for a molding process, it is possible to realize reduction in molding cost.

In still another preferable aspect of the second construction of the present invention, the peripheral edge of the flange-shaped valve seat is rounded off.

Rounding off the outer edge of the flange-shaped valve seat facilitates the pressing the first cylindrical body into the second cylindrical body.

In still another preferable aspect of the second construction of the present invention, the end portion of the first cylindrical body, on which the flange-shaped valve seat of the pillar-shaped body is formed, is formed separately from the remaining part of the first cylindrical body and is fixed to the base portion of the pillar-shaped body, and the end portion is formed of an elastomer material.

By forming the end portion of the first cylindrical body, on which the flange-shaped valve seat of the pillar-shaped body is formed, of the elastomer material, it is possible to improve the sealing performance of a portion at which the flange-shaped valve seat abuts against the annular valve body and to easily press the first cylindrical body into the second cylindrical body.

In still another preferable aspect of the second construction of the present invention, the first cylindrical body and the second cylindrical body are provided with protrusions over which each can climb over the other.

The protrusions may be formed in an annular shape on one of the first cylindrical bodies and the second cylindrical body, for example, whereas a plurality of protrusions may be formed on the other one. Further, the protrusions can be also formed on both of them in the annular shape. Still further, the plurality of protrusions may be formed on each of them.

The cross section of the protrusion can be formed in the shape of an arc, a triangle, or a rectangle, but may be in another shape.

Moreover, it is preferable that the first cylindrical body and the second cylindrical body are formed of hard resin.

When the second cylindrical body is moved to the base side of the first cylindrical body, the protrusion of the second cylindrical body abuts against the protrusion of the first cylindrical body. When the second cylindrical body is further moved, the protrusion of the second cylindrical body climbs over the protrusion of the first cylindrical body.

The plurality of protrusions may be formed on the second cylindrical body and the first cylindrical body, so that the second cylindrical body can be stopped at a plurality of positions.

The protrusion of the second cylindrical body can be stopped between one protrusion and another protrusion of the first cylindrical body. Moreover, it is preferable that the first cylindrical body is provided with a stopper against which the second cylindrical body can abut from the upstream side and that, when the protrusion of the second cylindrical body climbs over the protrusion of the first cylindrical body, the second cylindrical body abuts against the stopper. This constitution can prevent a switching cylinder from rattling.

Until the protrusion of the second cylindrical body abuts against the protrusion of the first cylindrical body, the frictional resistance caused by sliding is substantially constant and small in magnitude, and until the protrusion of the second cylindrical body that abutted against the protrusion of the first cylindrical body climbs over it, the frictional resistance is large to deform the second cylindrical body and the first cylindrical body. Then, after the protrusion of the second cylindrical body climbs over the protrusion of the first cylindrical body, the frictional resistance suddenly becomes small.

The user moves the second cylindrical body and recognizes that the protrusions abut against each other by a change in the frictional resistance and applies a large force thereto. As the frictional resistance suddenly changes when the protrusions climb over each other, the user can detect the switching as a feeling and quickly relax the force.

When water is made to flow in a state where the protrusions climb over each other, the second cylindrical body is to be moved downstream by the hydraulic pressure. However, as the protrusions are engaged with each other, the second cylindrical body is stopped at the engaging position.

In still another preferable aspect of the second construction of the present invention, there is further provided with means for reducing an area of a water flow passage from the air/water mixing chamber to the air suction port in order to prevent water from flowing from the air/water mixing chamber to the air suction port at the time when the foaming water is discharged.

By providing a construction like this, even in the water discharge switching device in which the shower water discharge port of the shower water discharging means forms the air suction port of the foaming water producing and discharging means, it is possible to prevent a water leak from being caused by flowing water to the air suction port side when the foaming water is discharged.

In still another preferable aspect of the second construction of the present invention, a top end slit portion formed in the second cylindrical body is formed in the shape of a fin and the top end surface of the top end slip portion is made to abut against the bottom surface of the partition wall of the first cylindrical body to reduce the area of the water flow passage.

By providing a construction like this, air from the air suction port is easily taken in whereas it is difficult for water from the water inlet to flow into the air suction port because of a difference in viscosity between air and water, so that it is possible to prevent a water leak from being caused by water flowing to the air suction port side at the time when the foaming water is discharged.

In still another preferable aspect of the second construction of the present invention, the above-mentioned top end slit portion is formed as a separate part.

By providing a construction like this, it is possible to replace the part according to the circumstances of use and to easily maintain the part so as to prevent clogging caused by dust or the like.

In still another preferable aspect of the second construction of the present invention, a plurality of small holes are formed, through in a radial direction, in the tip portion of the inner cylinder of the above-mentioned second cylindrical body and the top end surface of the tip portion of the inner cylinder is made to abut against the bottom surface of the partition wall of the first cylindrical body to reduce the area of the above-mentioned water flow passage.

By providing a construction like this, it is possible to increase the surface tension of water and to prevent water from leaking to the side of the shower water small holes at the time when the foaming water is discharged.

In still another preferable aspect of the second construction of the present invention, the above-mentioned tip portion having the plurality of small holes is formed as a separate part.

By providing a constitution like this, it is possible to replace the part according to the circumstances of use and to easily maintain the part so as to prevent clogging caused by dust or the like.

A third construction of a water discharge switching device in accordance with the present invention is a water discharge switching device including: foaming water producing and discharging means having a water inlet, an air/water mixing chamber facing the water inlet and capable of communicating with the water inlet, an air suction port capable of communicating with the air/water mixing chamber, and a foaming water outlet; shower water discharging means having a shower water discharge port and capable of communicating with the water inlet, the shower water discharging means being arranged around the air/water mixing chamber of the foaming water producing and discharging means; and water discharge switching means for selectively switching between the discharge of foaming water from the foaming water producing and discharging means and the discharge of shower water from the shower water discharging means, in which the shower water discharge port of the shower water discharging means forms the air suction port of the foaming water producing and discharging means, and the water discharge switching means is means for opening and closing a communication passage between the air/water mixing chamber and the foaming water outlet of the foaming water producing and discharging means, the water discharge switching device further comprising: a first cylindrical body having a partition wall for defining an inflow chamber and a discharge chamber which are adjacent to each other in the longitudinal direction, a pillar-shaped body extending from the partition wall to form the discharge chamber in an annular shape and having a flange-shaped valve seat formed at its end portion, and a plurality of first small-diameter holes formed in the partition wall in a manner surrounding the pillar-shaped body near the pillar-shaped body; and a second cylindrical body having an inner cylinder and an outer cylinder which are concentrically arranged, an end wall for closing one end of a first annular gap formed between the inner cylinder and the outer cylinder, a plurality of second small-diameter holes formed in the end wall with a gap between them in a circumferential direction, and an annular valve body extending from an inner peripheral surface of the inner cylinder, the outer cylinder of the second cylindrical body being externally fitted on the first cylindrical body such that the outer cylinder can move relatively in a vertical direction and a fitting portion thereof being sealed, the inner cylinder of the second cylindrical body moving into the discharge chamber of the first cylindrical body outside in a radial direction of the first the shower water discharge port to form a second annular gap between the inner cylinder and a peripheral wall of the first cylindrical body forming an outer peripheral wall of the discharge chamber and a third annular gap between the inner cylinder and the pillar-shaped body, and the annular valve body facing to the flange-shaped valve seat in the third annular gap, being characterized in that a predetermined region in the circumferential direction of the outer surface of the above-mentioned end wall is inclined from the inner cylinder to the outer cylinder in a direction closer to the open end of the above-mentioned first annular gap, and that a remaining region in the circumferential direction of the outer surface of the above-mentioned end wall is perpendicular to the second small-diameter holes.

A shower flow discharged from the second small-diameter holes formed in the above-mentioned predetermined region in the circumferential direction of the end wall is diffused in a radial shape, and a shower flow discharged from the above-mentioned remaining region in the circumferential direction of the end wall goes straight ahead. The shower flow going straight ahead fills a space surrounded by the diffused shower flow and forms a suitable shower flow widely and uniformly hitting an objective part to be cleaned.

A fourth construction of a water discharge switching device in accordance with the present invention is a water discharge switching device including: foaming water producing and discharging means having a water inlet, an air/water mixing chamber facing the water inlet and capable of communicating with the water inlet, an air suction port capable of communicating with the air/water mixing chamber, and a foaming water outlet; shower water discharging means having a shower water discharge port and capable of communicating with the water inlet, the shower water discharging means being arranged around the air/water mixing chamber of the foaming water producing and discharging means; and water discharge switching means for selectively switching between the discharge of foaming water from the foaming water producing and discharging means and the discharge of shower water from the shower water discharging means, in which the shower water discharge port of the shower water discharging means forms the air suction port of the foaming water producing and discharging means, and the water discharge switching means is means for opening and closing a communication passage between the air/water mixing chamber and the foaming water outlet of the foaming water producing and discharging means, the water discharge switching device further comprising: a first cylindrical body having a partition wall for defining an inflow chamber and a discharge chamber which are adjacent to each other in a vertical direction, a pillar-shaped body extending from the partition wall to form the discharge chamber in an annular shape and having a flange-shaped valve seat formed at its end portion, and a plurality of first small-diameter holes formed in the partition wall in a manner surrounding the pillar-shaped body near the pillar-shaped body; and a second cylindrical body having an inner cylinder and an outer cylinder which are concentrically arranged, an end wall for closing one end of a first annular gap formed between the inner cylinder and the outer cylinder, a plurality of second small-diameter holes formed in the end wall with a gap between them in a circumferential direction, and an annular valve body extending from an inner peripheral surface of the inner cylinder, the outer cylinder of the second cylindrical body being externally fitted on the first cylindrical body in such a way that it can move relatively in the vertical direction and a fitting portion thereof is sealed, the inner cylinder of the second cylindrical body moving into the discharge chamber of the first cylindrical body outside in a radial direction of the first shower water discharge port to form a second annular gap between the inner cylinder and a peripheral wall of the first cylindrical body forming an outer peripheral wall of the discharge chamber and a third annular gap between the inner cylinder and the pillar-shaped body, and the annular valve body facing to the flange-shaped valve seat in the third annular gap, being characterized in that the plurality of second small-diameter holes are arranged in a manner of a plurality of concentric circles having different diameters and that an angle formed by a direction in which the second small-diameter holes extend and a direction in which the inner cylinder and the outer cylinder of the second cylindrical body extend varies for each circle in which the second small-diameter holes are arranged.

A plurality of annular shower flows having different discharge angles for the respective circles are discharged, so that it is possible to enlarge a region to be showered and increase a feeling of volume of the shower flow.

A fifth constitution of a water discharge switching device in accordance with the present invention is a water discharge switching device including: foaming water producing and discharging means having a water inlet, an air/water mixing chamber facing the water inlet and capable of communicating with the water inlet, an air suction port capable of communicating with the air/water mixing chamber, and a foaming water outlet; shower water discharging means having a shower water discharge port and capable of communicating with the water inlet, the shower water discharging means being arranged around the air/water mixing chamber of the foaming water producing and discharging means; and water discharge switching means for selectively switching between the discharge of foaming water from the foaming water producing and discharging means and the discharge of shower water from the shower water discharging means, being characterized in that the shower water discharge port of the shower water discharging means forms the air suction port of the foaming water producing and discharging means, that the water discharge switching means is a means for opening and closing a communication passage between the air/water mixing chamber and the foaming water outlet of the foaming water producing and discharging means, and that the above-mentioned foaming water producing and discharging means and the above-mentioned shower water discharging means are formed by fitting a first cylindrical body which is an inner cylindrical body in a second cylindrical body which is an outer cylindrical body and a switching bar provided in a switching button abuts against the top end of a flange-shaped valve seat and the above-mentioned switching bar is moved up and down by operating the above-mentioned switching button to move up and down the above-mentioned flange-shaped valve seat to switch water discharge.

An operation of switching the water discharge can be performed by the switching button, so that it is possible to improve operability. Moreover, the water discharge can be switched without touching the second cylindrical body in which warm water and the like flows. This can prevent the occurrence of a scald and improve safety and is preferable from the viewpoint of sanitation.

A sixth construction of a water discharge switching device in accordance with the present invention is a water discharge switching device including: foaming water producing and discharging means having a water inlet, an air/water mixing chamber facing to the water inlet and capable of communicating with the water inlet, an air suction port capable of communicating with the air/water mixing chamber, and a foaming water outlet; shower water discharging means having a shower water discharge port and capable of communicating with the water inlet, the shower water discharging means being arranged around the air/water mixing chamber of the foaming water producing and discharging means; and water discharge switching means for selectively switching between the discharge of foaming water from the foaming water producing and discharging means and the discharge of shower water from the shower water discharging means, being characterized in that the shower water discharge port of the shower water discharging means forms the air suction port of the foaming water producing and discharging means, that the water discharge switching means is means for opening and closing a communication passage between the air/water mixing chamber and the foaming water outlet of the foaming water producing and discharging means, that the above-mentioned foaming water producing and discharging means and the above-mentioned shower water discharging means are formed by fitting a first cylindrical body which is an inner cylindrical body in a second cylindrical body which is an outer cylindrical body, and that a cam having peaks and valleys formed at regular intervals along the circumferential direction of the inner cylinder is provided on an inner lower side of an inner cylinder of the above-mentioned second cylindrical body and a plurality of protrusions protruding in a radial direction are provided on an outer peripheral portion of a flange portion of a flange-shaped valve seat and the above-mentioned cam slides on the above-mentioned protrusions with a turn of the above-mentioned second cylindrical body to make the above-mentioned protrusions alternately abut against the peaks and valleys of the above-mentioned cam to move up and down the above-mentioned flange-shaped valve seat to thereby switch water discharge.

Only by turning the second cylindrical body in a circumferential direction, it is possible to continuously alternately switch between the discharge of foaming water and the discharge of shower water and to switch the water discharge even if a turning direction is in either of two directions, so that it is possible to improve operability. Moreover, a stepped portion is not produced between the first cylindrical body and the second cylindrical body with the switching of water discharge, so that dust does not accumulate at this stepped portion.

A seventh construction of a water discharge switching device in accordance with the present invention includes: foaming water producing and discharging means having a water inlet, an air/water mixing chamber facing the water inlet and capable of communicating with the water inlet, an air suction port capable of communicating with the air/water mixing chamber, and a foaming water outlet; shower water discharging means having a shower water discharge port and capable of communicating with the water inlet, the shower water discharging means being arranged around the air/water mixing chamber of the foaming water producing and discharging means; and water discharge switching means for selectively switching between the discharge of foaming water from the foaming water producing and discharging means and the discharge of shower water from the shower water discharging means, and is characterized in that the shower water discharge port of the shower water discharging means forms the air suction port of the foaming water producing and discharging means, that the water discharge switching means is a means for opening and closing a communication passage between the air/water mixing chamber and the foaming water outlet of the foaming water producing and discharging means, and that the above-mentioned foaming water producing and discharging means and the above-mentioned shower water discharging means are formed by screwing a first cylindrical body which is an inner cylindrical body in a second cylindrical body which is an outer cylindrical body and the above-mentioned first cylindrical body is provided with a spline portion and the spline portion of the first cylindrical body can be fitted on the spline portion of a faucet hardware unit.

By providing a construction like this, in a case where a directional part such as a lever is required to direct toward a predetermined position, it is possible to easily position the part by adjusting the fitting position of the spline portions.

Moreover, the state of water discharge is switched by turning the second cylindrical body with respect to the first cylindrical body, and by the use of the fitting of the spline portions, when the second cylindrical body is turned at the time when the water discharge is switched, the spline portions can receive turning torque, so that it does not happen that the fitting portion is loosened as is the case with the conventional fitting by the use of screw fitting.

In a preferable aspect of the seventh construction of the present invention, the above-mentioned first cylindrical body and the above-mentioned second cylindrical body provisionally fixed to this first cylindrical body can be fitted on the faucet hardware unit with the flange-shaped valve seat.

By providing a construction like this, in the water discharge switching device in which the shower water discharge port of the shower water discharging means forms the air suction port of the foaming water producing and discharging means, although the diameter of the screw portion of the flange-shaped valve seat for fixing can not be enlarged according to the miniaturizing of the water discharge switching device, the spline portions receive the turning torque at the time of the turning operation and thus the turning torque load applied to the screw portion of the flange-shaped valve seat can be reduced. Thus, even if the diameter of the screw portion of the flange-shaped valve seat is small, it is possible to properly perform the turning operation and to prevent the flange-shaped valve seat from being broken or loosened.

An eighth construction of a water discharge switching device in accordance with the present invention includes: foaming water producing and discharging means having a water inlet, an air/water mixing chamber facing the water inlet and capable of communicating with the water inlet, an air suction port capable of communicating with the air/water mixing chamber, and a foaming water outlet; shower water discharging means having a shower water discharge port and capable of communicating with the water inlet, the shower water discharging means being arranged around the air/water mixing chamber of the foaming water producing and discharging means; and water discharge switching means for selectively switching between the discharge of foaming water from the foaming water producing and discharging means and the discharge of shower water from the shower water discharging means, and is characterized in that the shower water discharging port of the shower water discharging means forms the air suction port of the foaming water producing and discharging means, that the water discharge switching means is a means for opening and closing a communication passage between the air/water mixing chamber and the foaming water outlet of the foaming water producing and discharging means, and that the above-mentioned foaming water producing and discharging means and the above-mentioned shower water discharging means are formed by screwing a first cylindrical body which is an inner cylindrical body in a second cylindrical body which is an outer cylindrical body and a part, on a side fitted to the above-mentioned faucet hardware unit, of the above-mentioned first cylindrical body and the above-mentioned second cylindrical body is fixed to a spout body so as to be buried therein.

By providing a construction like this, the portion of the first cylindrical body the top of which is exposed to the second cylindrical body, is covered with the spout body. This is not only preferable in the outward appearance, but also can prevent dust from adhering to the surface of the first cylindrical body.

A ninth construction of a water discharge switching device in accordance with the present invention includes: foaming water producing and discharging means having a water inlet, an air/water mixing chamber facing to the water inlet and capable of communicating with the water inlet, an air suction port capable of communicating with the air/water mixing chamber, and a foaming water outlet; shower water discharging means having a shower water discharge port and capable of communicating with the water inlet, the shower water discharging means being arranged around the air/water mixing chamber of the foaming water producing and discharging means; and water discharge switching means for selectively switching between the discharge of foaming water from the foaming water producing and discharging means and the discharge of shower water from the shower water discharging means, and is characterized in that the shower water discharging port of the shower water discharging means forms the air suction port of the foaming water producing and discharging means, that the water discharge switching means is a means for opening and closing a communication passage between the air/water mixing chamber and the foaming water outlet of the foaming water producing and discharging means, and that the above-mentioned foaming water producing and discharging means and the above-mentioned shower water discharging means are formed by screwing a first cylindrical body which is an inner cylindrical body in a second cylindrical body which is an outer cylindrical body and the gap between the joining portion of the first cylindrical body and a faucet hardware unit is packed with an O-ring.

In this manner, it is possible to prevent a water leak caused by flowing water to the air suction port side at the time when the foaming water is discharged and at the same time, to pack the gap produced between the connection portion of the device and the faucet hardware unit when the water discharge switching device is fitted on the faucet hardware unit to thereby prevent dust from accumulating at the connection portion, and to produce a mode preferable in the outward appearance.

DETAILED DESCRIPTION OF THE INVENTION

In order to describe the present invention in more detail, the present invention will be described with reference to the accompanying drawings.

First, a water discharge switching device in accordance with a first embodiment of the present invention will be described.

Figure 1:
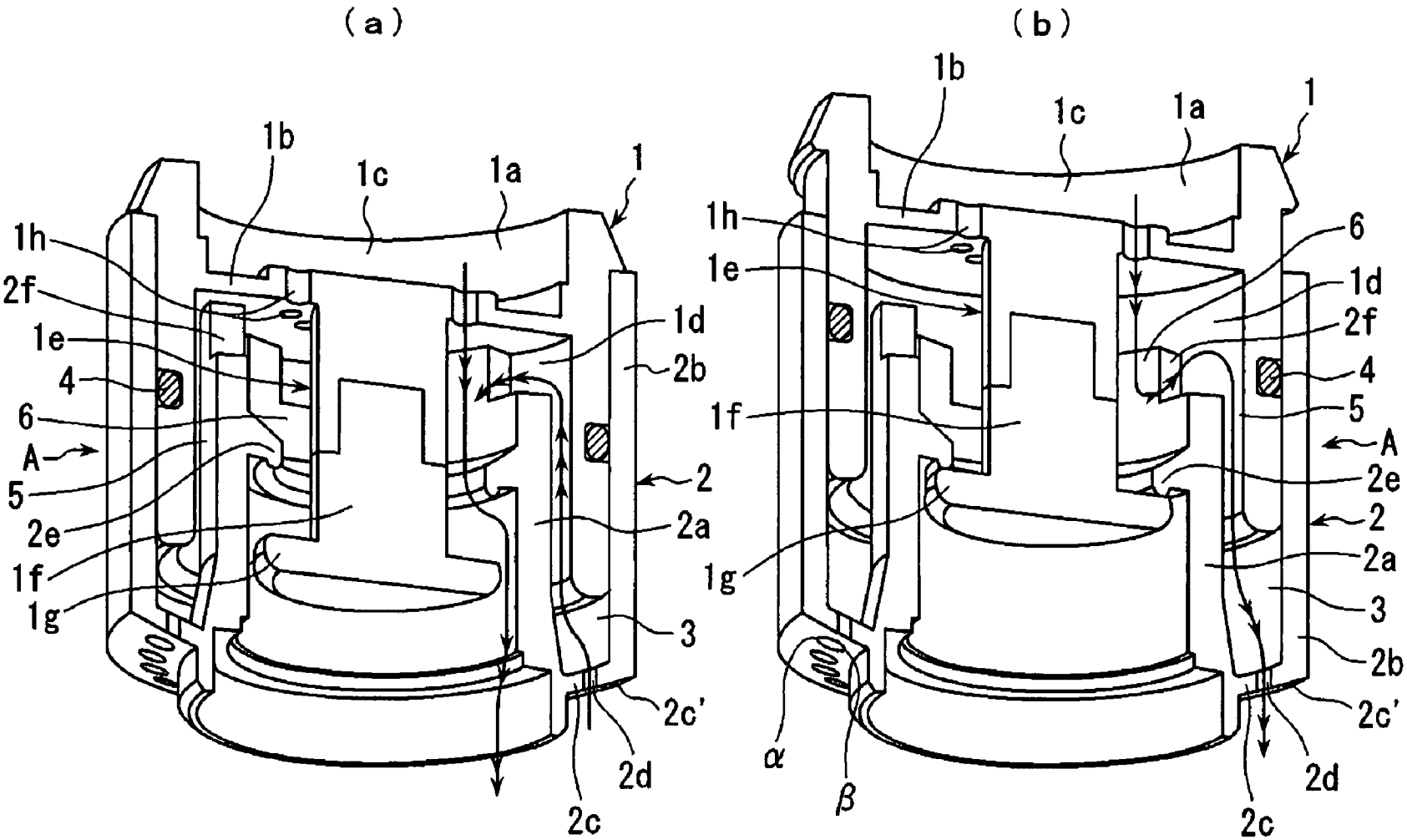
FIGS. 1A and 1B are cross-sectional views of a water discharge switching device in accordance with a first embodiment of the present invention.

As shown in FIGS. 1A and 1B, a water discharge switching device A has a first cylindrical body 1. A fitting portion 1*a* to be fitted to an existing faucet is formed at one end of the first cylindrical body 1. Near the fitting portion 1*a* is formed a partition wall 1*b*. An inflow chamber 1*c* and a discharge chamber 1*d* which are adjacent to each other in a longitudinal direction of the first cylindrical body 1 are defined by the partition wall 1*b*. The inflow chamber 1*c* is opposed to the fitting portion 1*a*.

A pillar-shaped body 1*e* extends in a longitudinal direction from the central portion of the partition wall 1*b* to form the discharge chamber 1*d* in an annular shape. A flange-shaped valve seat 1*g* is formed at an end portion 1*f* of the pillar-shaped body 1*e*. The end portion 1*f* of the pillar-shaped body 1*e* is formed separately from the other parts of the first cylindrical body 1 and is fixedly screwed into a base portion of the pillar-shaped body 1*e*. The end portion 1*f* is constituted of an elastomer material.

A plurality of first small-diameter holes 1*h* are formed in the partition wall 1*b* near the pillar-shaped body 1*e* in such a way as to surround the pillar-shaped body 1*e*.

The water discharge switching device A has a second cylindrical body 2. The second cylindrical body 2 has an inner cylinder 2*a* and an outer cylinder 2*b*, which are concentrically arranged, and an end wall 2*c* for closing one end of a first annular gap 3 formed between the inner cylinder 2*a* and the outer cylinder 2*b*. In the end wall 2*c* are formed a plurality of second small-diameter holes 2*d* at intervals in a circumferential direction. The second small-diameter holes 2*d* are formed in parallel to the inner cylinder 2*a* and the outer cylinder 2*b*. An outer surface 2*c*' of the end wall 2*c* is inclined from the inner cylinder 2*a* to the outer cylinder 2*b* in a direction closer to an open end of the first annular gap 3.

An annular valve body 2*e* extends from the inner peripheral surface of the inner cylinder 2*a* closer to the open end of the first annular gap 3. A plurality of notches 2*f* are formed at given intervals in the circumferential direction on the end portion of the inner cylinder 2*a* on the open end side of the first annular gap 3.

A stream straightening plate having a mesh structure (not shown) is fixed to the end closer to the second small-diameter holes 2*d* of the inner cylinder 2*a*.

The outer cylinder 2*b* of the second cylindrical body 2 is tightly fitted on the outside of the first cylindrical body 1 in such a manner that the outer cylinder 2*b* can relatively slide in a vertical direction. The sliding portion of the outer cylinder 2*b* and the first cylindrical body 1 is sealed by an O-ring 4.

The inner cylinder 2*a* of the second cylinder 2 enters the discharge chamber 1*d* of the first cylindrical body 1 on the outer side in a radial direction of the first the shower water discharge port 1*h* to form a second annular gap 5 between the inner cylinder 2*a* and the peripheral wall of the first cylindrical body 1 forming the outer peripheral wall of the discharge chamber 1*d* and a third annular gap 6 between the inner cylinder 2*a* and the pillar-shaped body 1*e*. The annular valve body 2*e* faces to the flange-shaped valve seat 1*g* in the third annular gap 6.

The operation of the water discharge switching device A will be described.

The water discharge switching device A is fitted for use to a new faucet via the fitting portion 1*a* or is retrofitted for use to an existing faucet.

As shown in FIG. 1A, when the annular valve body 2*e* is separated from the flange-shaped valve seat 1*g*, as shown by a double arrow, water flowing into the inflow chamber 1*c* flows into the third annular gap 6 through the first small-diameter holes 1*h*. Since the inner cylinder 2*a* of the second cylindrical body 2 is outside in the radial direction of the first small-diameter holes 1*h*, it is difficult for water flowing through the first small-diameter holes 1*h* to flow into the second annular gap 5 through the notches 2*f*.

Air sucked through the second small-diameter holes 2*d*, as shown by a triple arrow, flows through the second annular gap 5 and the notches 2*f* into the third annular gap 6. The water is mixed with air in a portion of the third annular gap 6, which is nearer to the first small-diameter holes 1*h* than the flange-shaped valve seat 1*g*, to produce foaming water.

The foaming water flows through a gap between the annular valve body 2*e* and the flange-shaped valve seat 1*g*, flows out from the third annular gap 6, reaches the end portion of the inner cylinder 2*a*, is straightened through a stream straightening plate (not shown) and then is discharged from the end portion of the inner cylinder 2*a*.

As shown in FIG. 1B, when the second cylindrical body 2 moves relatively in the vertical direction with respect to the first cylindrical body 1 and the annular valve body 2*e* abuts against the flange-shaped valve seat 1*g*, as shown by a double arrow, water flowing through the first small-diameter holes 1*h* into the third annular gap 6 fills the third annular gap 6 closed at its downstream end, overflows the third annular gap 6, and flows into the second annular gap 5. The water flowing into the second annular gap 5 is discharged as a shower flow from the second small-diameter holes 2*d*.

The outer surface 2*c*' of the end wall 2*c* is inclined from the inner cylinder 2*a* to the outer cylinder 2*b* in the direction close to the open end of the first annular gap 3. Therefore, when the shower flow is opened to the atmosphere at the end portions of the second small-diameter holes 2*d*, the timing when the shower flow is opened to the atmosphere from a first position α on the peripheral edge of the the shower water discharge port 2*d*, which is closer to the outer cylinder 2*b*, is made earlier than the timing when the shower flow is opened to the atmosphere from a second position β on the peripheral edge of the the shower water discharge port 2*d*, which is closer to the inner cylinder 2*a*, to make the timing when air near the first position α is drawn by a discharging shower flow earlier than the timing when air near the second position β is drawn by the discharging shower flow, thereby making the timing when a negative pressure is produced near the first position α earlier than the timing when a negative pressure is produced near the first position β. As a result, the shower flow discharged from the second small-diameter holes 2*d* is drawn to the outer cylinder 2*b* side, thereby being diffused in the radial direction.

The second small-diameter holes 2*d* function as shower water discharge ports and function also as air suction ports for producing foaming water, so that it is easy to miniaturize the water discharge switching device A, as compared with a conventional water discharge switching device in which shower water discharge ports and air suction ports for producing foaming water are formed separately from each other.

A water discharge switching mechanism in which the second cylindrical body 2 is relatively moved in the vertical direction with respect to the first cylindrical body 1 to bring or separate the annular valve body 2*e* into contact with or from the flange-shaped valve seat 1*g* to switch between the discharge of the foaming water and the discharge of the shower water has a simple structure, so that the water discharge switching device A is easily miniaturized, improved in assembling performance and reduced in manufacturing cost, as compared with the conventional water discharge switching device.

The outer cylinder 2*b* of the second cylindrical body 2 is slidably and tightly fitted on the outside of the first cylindrical body 1, so that it is possible to move the second cylindrical body 2 securely relatively in the longitudinal direction with respect to the second cylindrical body 2 and thus to securely switch a water discharge mode.

Since the shower flow discharged from the second small-diameter holes 2*d* is diffused, it is possible to produce a suitable shower flow widely hitting on an objective part to be cleaned. If the second small-diameter holes 2*d* are directed in parallel to the inner cylinder 2*a* and the outer cylinder 2*b* of the second cylindrical body 2, when the second cylindrical body 2 is molded of resin, pins for molding the second small-diameter holes 2*d* can be opened together with molding dies, so it is possible to improve a molding work efficiency.

When the water discharge switching device A is assembled, the first cylindrical body 1 is pressed into the second cylindrical body 2. The end portion 1*f* where the flange-shaped valve seat 1*g* of the pillar-shaped body 1*e* is formed is formed of the elastomer material, so that the elasticity of the elastomer material facilitates the press of the first cylindrical body 1 into the second cylindrical body 2 and improves the sealing performance of a portion where the flange-shaped valve seat 1*g* abuts against the annular valve body 2*e*.

In a faucet provided with the water discharge switching device A, the water discharge can be easily switched.

The water discharge switching device A is provided with the fitting portion 1*a*, so that the water discharge switching device A is afterward fitted to an existing faucet. This can improve the convenience of the existing faucet.

A water discharge switching device in accordance with a second embodiment of the invention will be described.

Figure 2:
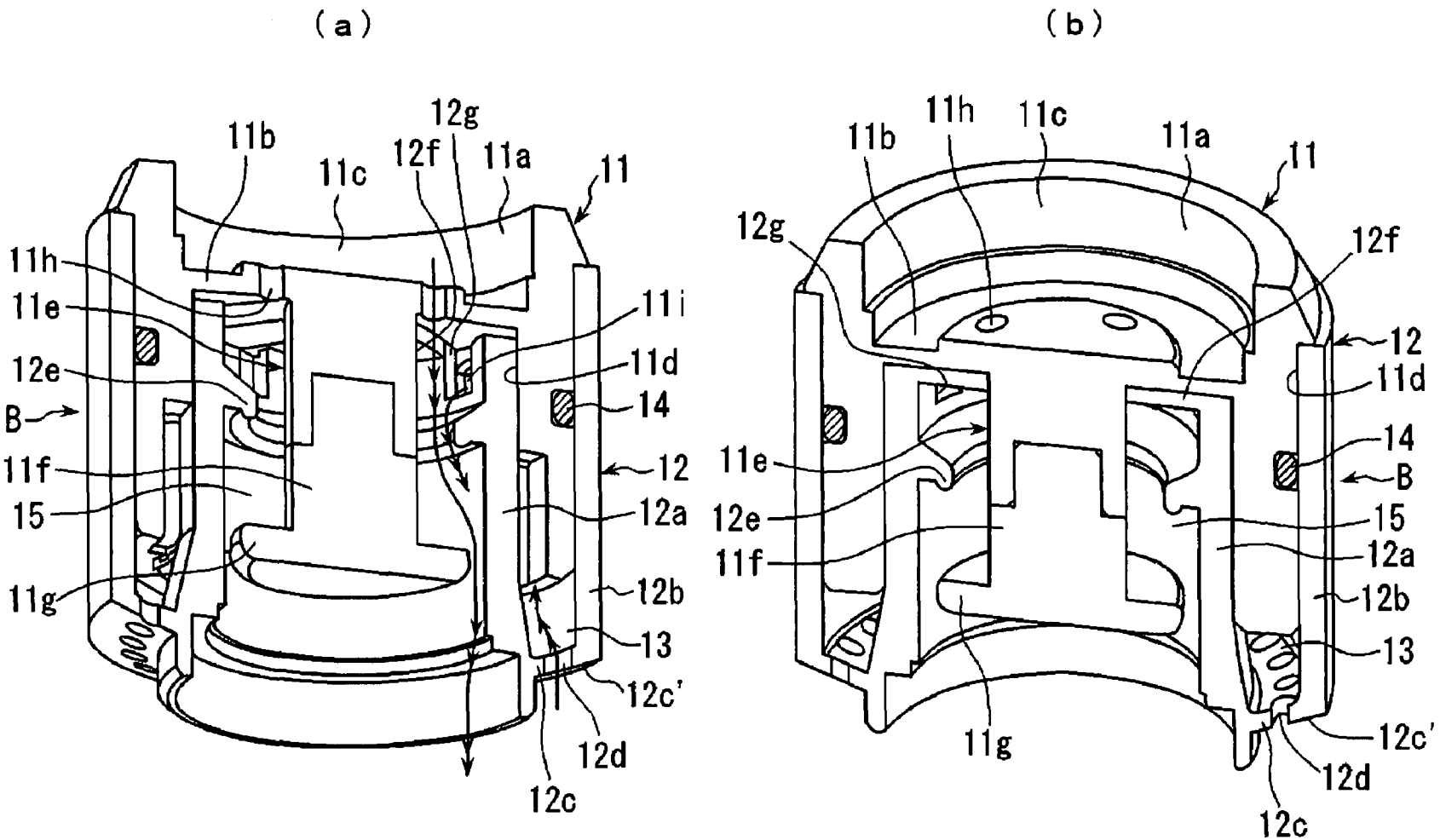
FIGS. 2A and 2B are cross-sectional views of a water discharge switching device in accordance with a second embodiment of the present invention.
Figure 3:
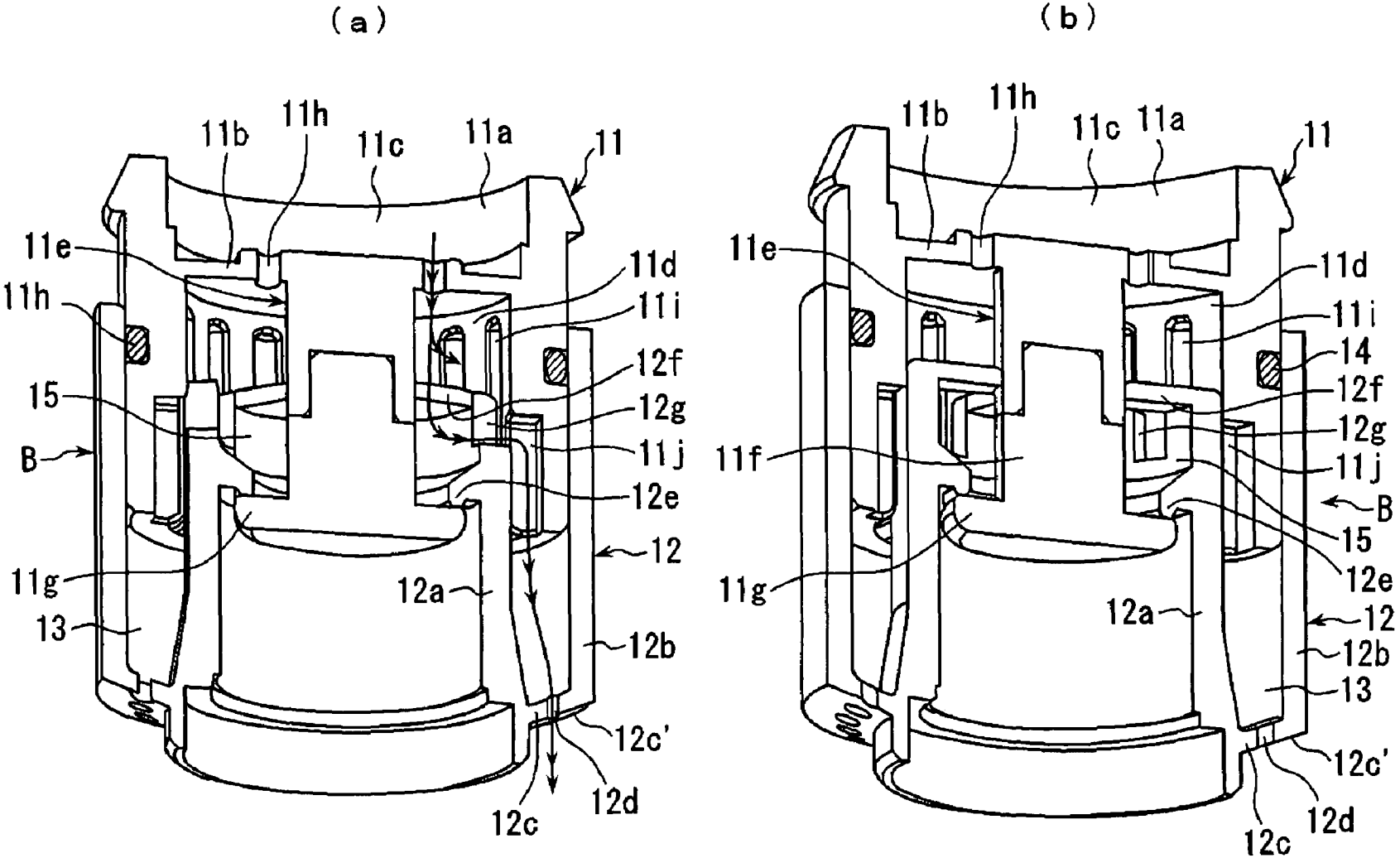
FIGS. 3A and 3B are cross-sectional views of the water discharge switching device in accordance with the second embodiment of the present invention.
FIG. 3C shows a partial cross-sectional view of the second cylindrical body of the water switching device in accordance with a variation of the second embodiment.
Figure 3C:
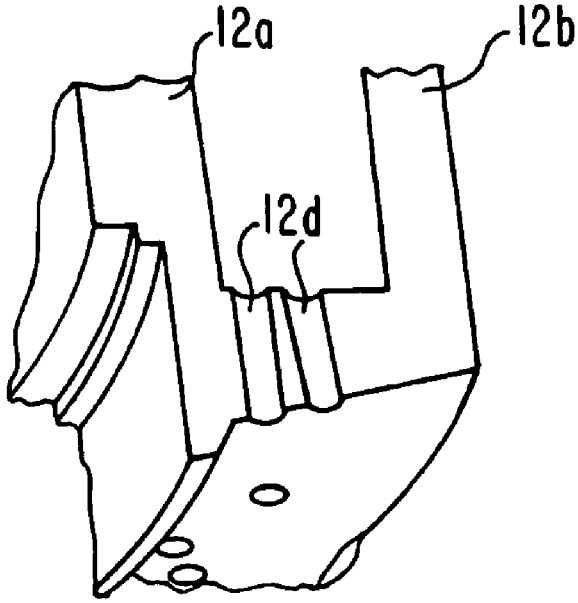
Figure 4:
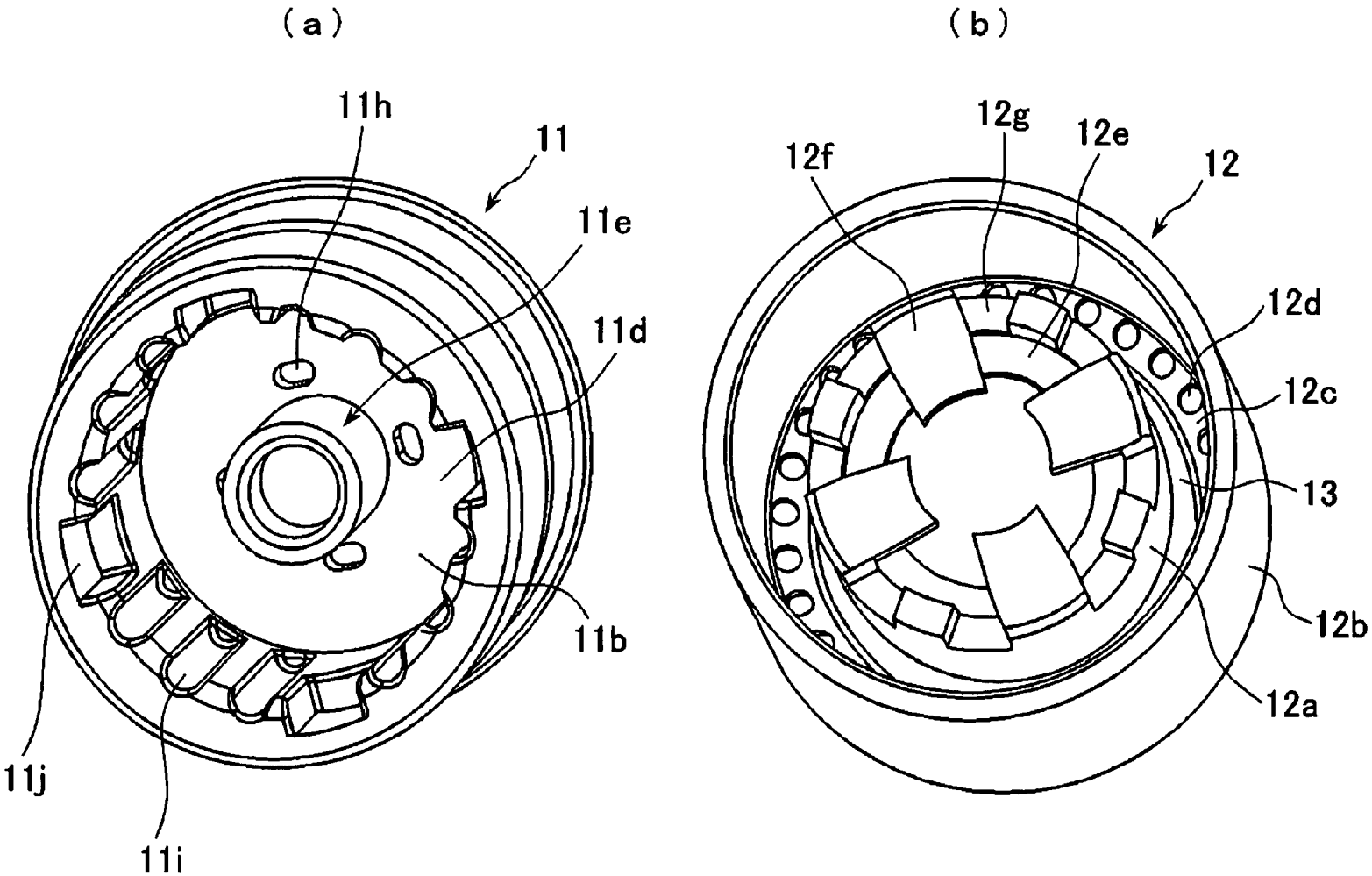
FIGS. 4(*a*) and 4(*b*) show exploded perspective views of the water discharge switching device in accordance with the second embodiment of the present invention, where (a) is a perspective view of a first cylindrical body and (b) is a perspective view of a second cylindrical body.

As shown in FIG. 2 to FIG. 4, a water discharge switching device B has a first cylindrical body 11. A fitting portion 11*a* to be fitted on an existing faucet is formed at one end of the first cylindrical body 11. Near the fitting portion 11*a* is formed a partition wall 11*b*. An inflow chamber 11*c* and a discharge chamber 11*d* which are adjacent to each other in a longitudinal direction of the first cylindrical body 11 are partitioned by the partition wall 11*b*. The inflow chamber 11*c* faces the fitting portion 11*a*.

A pillar-shaped body 11*e* extends in a longitudinal direction from the central portion of the partition wall 11*b* to form the discharge chamber 11*d* in an annular shape. A flange-shaped valve seat 11*g* is formed at an end portion 11*f* of the pillar-shaped body 11*e*. The end portion 11*f* of the pillar-shaped body 11*e* is formed separately from the other parts of the first cylindrical body 11 and is fixedly screwed into the base portion of the pillar-shaped body 11*e*. The end portion 11*f* is constituted of an elastomer material.

A plurality of first small-diameter holes 11*h* are formed in the partition wall 11*b* near the pillar-shaped body 11*e* in such a way as to surround the pillar-shaped body 11*e*.

A plurality of long grooves 11*i* and a plurality of short grooves 11*j* are formed on the inner surface of the peripheral wall of the first cylindrical body 11 forming the outer peripheral wall of the discharge chamber 11*d* in such a way that they are separated from each other at given intervals in a circumferential direction. The long grooves 11*i* and the short grooves 11*j* extend in the longitudinal direction of the first cylindrical body 11.

The water discharge switching device B has a second cylindrical body 12. The second cylindrical body 12 has an inner cylinder 12*a* and an outer cylinder 12*b*, which are concentrically arranged, and an end wall 12*c* for closing one end of a first annular gap 13 formed between the inner cylinder 12*a* and the outer cylinder 12*b*. In the end wall 12*c* are formed a plurality of second small-diameter holes 12*d* at intervals in the circumferential direction. The second small-diameter holes 12*d* are directed in parallel to the inner cylinder 12*a* and the outer cylinder 12*b*. An outer surface 12*c*' of the end wall 12*c* is inclined from the inner cylinder 12*a* to the outer cylinder 12*b* in a direction closer to an open end of the first annular gap 13.

An annular valve body 12*e* extends from the inner peripheral surface of the inner cylinder 12*a* closer to the open end of the first annular gap 13. Many claws 12*f* which are arranged at given intervals in the circumferential direction and extend inward in the radial direction from the end portion of the inner cylinder 12*a* and the number of which is equal to the number of the first small-diameter holes 11*h* are formed on the end portion of the inner cylinder 12*a* on the open end side of the first annular gap 13. Notches 12*g* are formed at portions extending between the claws 12*f* of the end portion of the inner cylinder 12*a*.

A stream straightening plate having a mesh structure (not shown) is fixed to the end closer to the second discharge holes 12*d* of the inner cylinder 12*a*.

The peripheral wall of the first cylindrical body 11 forming the outer peripheral wall of the discharge chamber 11*d* is fitted in the first annular gap 13 and abuts against the inner cylinder 12*a* and the outer cylinder 12*b* of the second cylindrical body 12 in such a way that it can slide in a longitudinal direction and in a circumferential direction. The sliding portion of the first cylindrical body 11 and the outer cylinder 12*b* of the second cylindrical body 12 is sealed by an O-ring 14.

The inner cylinder 12*a* of the second cylinder 12 enters the discharge chamber 11*d* of the first cylindrical body 11 on the outer side in the radial direction of the first the shower water discharge port 11*h* to form a second annular gap 15 between the inner cylinder 12*a* and the pillar-shaped body 11*e*. The annular valve body 12*e* faces to the flange-shaped valve seat 11*g* in the second annular gap 15.

The operation of the water discharge switching device B will be described.

The water discharge switching device B is fitted for use to a new faucet via the fitting portion 11*a* or is afterward fitted for use to an existing faucet.

As shown in FIG. 2A, when the annular valve body 12*e* is separated from the flange-shaped valve seat 11*g* and the claws 12*f* of the second cylindrical body 12 abut against the partition wall 11*b* of the first cylindrical body 11 and do not cover the first small-diameter holes 11*h*, the notches 12*g* face to the end portions of the long grooves 11*i*. Water flowing into the inflow chamber 11*c*, as shown by a double arrow, flows through the first small-diameter holes 11*h* into the second annular gap 15. Since the inner cylinder 12*a* of the second cylindrical body 12 is outside in the radial direction of the first small-diameter holes 11*h*, water flowing through the first small-diameter holes 11*h* is hard to flow through the notches 12*g* and the long grooves 11*i* into the first annular gap 13.

As shown by a triple arrow, air sucked through the second small-diameter holes 12*d* flows through the plurality of long grooves 11*i* formed on the inner peripheral wall surface of the first cylindrical body 11 and the plurality of notches 12*g* formed on the end portion of the inner cylinder 12*a* of the second cylindrical body 12 into the second annular gap 15. The water is mixed with air in a portion of the second annular gap 15, which is nearer to the first small-diameter holes 11*h* than the flange-shaped valve seat 11*g*, to produce foaming water.

The foaming water flows through a gap between the annular valve body 12*e* and the flange-shaped valve seat 11*g*, flows out of the second annular gap 15, reaches the end portion of the inner cylinder 12*a* of the second cylindrical body 12, is straightened through a stream straightening plate (not shown) and then is discharged from the end portion of the inner cylinder 12*a*.

As shown in FIG. 2B, when the second cylindrical body 12 turns relatively with respect to the first cylindrical body 11 and the claws 12*f* of the second cylindrical body 12 cover parts of the first small-diameter holes 11*h*, the quantity of water flowing into the second annular gap 15 decreases and thus a foaming water discharge flow decreases. By adjusting the quantity of relative turn of the second cylindrical body with respect to the first cylindrical body 11 to adjust the extent to which the claws 12*f* cover the first small-diameter holes 11*h*, the foaming water discharge flow can be adjusted.

As shown in FIG. 3A, the second cylindrical body 12 moves relatively in the vertical direction with respect to the first cylindrical body 11 and the annular valve body 12*e* abuts against the flange-shaped valve seat 11*g*, the claws 12*f* of the second cylindrical body 12 are separated from the partition wall 11*b* of the first cylindrical body 11 to open the first small-diameter holes 11*h*.

Of the plurality of long grooves formed on the inner surface of the peripheral wall of the first cylindrical body 11, the long grooves 11*i* extend over the end portion of the peripheral wall of the inner cylinder 12*a* of the second cylindrical body 12 and the end portions of the short grooves 11*j* do not extend to the end portion of the peripheral wall of the inner cylinder 12*a* of the second cylindrical body 12.

Water flowing into the inflow chamber 11*c*, as shown by a double arrow, flows through the first small-diameter holes 11*h* into the second annular gap 15. A part of water filling the second annular gap 15 closed at its downstream end flows into the long grooves 11*i* of the plurality of grooves formed on the inner surface of the peripheral wall of the first cylindrical body 11. The remaining part of the water flows through the notches 12*g* formed on the end portion of the inner cylinder 12*a* of the second cylindrical body 12 into the short grooves 11*j* of the plurality of grooves formed on the inner surface of the peripheral wall of the first cylindrical body 11.

The water flowing through the plurality of grooves 11*i* and 11*j* formed on the inner surface of the peripheral wall of the first cylindrical body 11 flows into the first annular gap 13 between the end portion of the peripheral wall of the first cylindrical body 11 and the end wall 12*c* of the second cylindrical body 12 and flows out as a shower flow from the second small-diameter holes 12*d*. The shower flow discharged from the second small-diameter holes 12*d* is diffused in the radial direction.

As shown in FIG. 3B, the second cylindrical body 12 relatively turns with respect to the first cylindrical body 11 and the portions extending between the notches 12*g* of the end portion of the inner cylinder 12*a* of the second cylindrical body 12 cover parts of the end portions of the short grooves 11*j* of the grooves formed on the inner surface of the peripheral wall of the first cylindrical body 11. Thereby, the quantity of water flowing into the short grooves 11*j* decreases and the quantity of discharge of the shower water decreases. By adjusting the quantity of relative turn of the second cylindrical body 12 with respect to the first cylindrical body 11 to adjust the extent to which the portions extending between the notches 12*g* of the end portion of the inner cylinder 12*a* of the second cylindrical body 12 cover the end portions of the short grooves 11*j* of the grooves formed on the inner surface of the peripheral wall of the first cylindrical body 11, it is possible to adjust a shower water discharge flow.

The second small-diameter holes 12*d* function as shower water discharge ports and function also as air suction ports for producing foaming water, so that it is easy to miniaturize the water discharge switching device B, as compared with a conventional water discharge switching device in which shower water discharge ports and air suction ports for producing foaming water are formed separately from each other.

A water discharge switching mechanism in which the second cylindrical body 12 is relatively moved in the vertical direction with respect to the first cylindrical body 11 to bring or separate the annular valve body 12*e* into contact with or from the flange-shaped valve seat 11*g* to switch between the discharge of the foaming water and the discharge of the shower water has a simple structure. Therefore, the water discharge switching device B is easily miniaturized, improved in assembling performance and reduced in manufacturing cost, compared with the conventional water discharge switching device.

By relatively turning the second cylindrical body 12 with respect to the first cylindrical body 11, it is possible to adjust the foaming water discharge flow and the shower water discharge flow.

In a faucet provided with the water discharge switching device B, it is possible to easily switch the water discharge and to adjust the water discharge flow.

In the water discharge switching device A, it is also recommended that a portion near the end portion on a side close to the second small-diameter holes 2*d* of the first cylindrical body 1 be screwed into a portion close to the second small-diameter holes 2*d* of the second outer cylinder 2*b* of the second cylindrical body 2. In the water discharge switching device B, it is also recommended that a portion near the end portion on a side close to the second small-diameter holes 12*d* of the first cylindrical body 11 be screwed into a portion close to the second small-diameter holes 12*d* of the second outer cylinder 12*b* of the second cylindrical body 12. In this manner, it is possible to securely relatively move the second cylindrical bodies 2, 12 in the longitudinal direction with respect to the first cylindrical bodies 1, 11 and to securely switch the water discharge mode. Moreover, it is possible to prevent the second cylindrical bodies 2, 12 from being inclined with respect to the first cylindrical bodies 1, 11 and to securely improve the reliability of sealing by the O-rings 4, 14.

In the water discharge switching device A, it is also recommended that a region in the predetermined circumferential direction of the outer surface 2*c*' of the end wall 2*c* be inclined from the inner cylinder 2*a* toward the outer cylinder 2*b* in a direction closer to the open end of the first annular gap 3 and a remaining region in the circumferential direction of the outer surface 2*c*' of the end wall 2*c* be perpendicular to the second small-diameter holes 2*d*. In the water discharge switching device B, it is also recommended that a region in the predetermined circumferential direction of the outer surface 12*c*' of the end wall 12*c* be inclined from the inner cylinder 12*a* toward the outer cylinder 12*b* in a direction closer to the open end of the first annular gap 13 and a remaining region in the circumferential direction of the outer surface 12*c*' of the end wall 12*c* be perpendicular to the second small-diameter holes 12*d*.

The shower flow discharged from the second small-diameter holes 2*d*, 12*d* formed in the region in the above-mentioned predetermined circumferential direction of the outer surfaces 2*c*', 12*c*' of the end walls is diffused in the radial direction and the shower flow discharged from the above-mentioned remaining region in the circumferential direction of the outer surface 2*c*', 12*c*' of the end wall goes straight ahead. The shower flow going straight fills a space surrounded by the diffused shower flow and forms a suitable shower flow that widely and uniformly hits an objective part to be cleaned.

In the water discharge switching device A, it is also recommended that the plurality of second small-diameter holes 2*d* be arranged on a plurality of concentric circles having different diameters and an angle formed by a direction in which the second small-diameter holes 2*d* extend and a direction in which the inner cylinder 2*a* and the outer cylinder 2*b* extend vary for the respective concentric circles of the second small-diameter holes 2*d*. In a modified version of the water discharge switching device B, as shown in FIG. 3(*c*), it is also recommended that the plurality of second small-diameter holes 12*d* be arranged on a plurality of concentric circles having different diameters and an angle formed by a direction in which the second small-diameter holes 12*d* extend and a direction in which the inner cylinder 12*a* and the outer cylinder 12*b* extend vary for the respective concentric circles of the second small-diameter holes 12*d*. In this case, the outer surface 2*c*', 12*c*' of the end wall may be perpendicular to the second small-diameter holes 2*d*, 12*d*.

A plurality of annular shower flows having different discharge angles for the respective concentric circles of the second small-diameter holes 2*d*, 12*d* are discharged, so that a region to be showered is enlarged and a feeling of the volume of the shower flow is increased.

In the water discharge switching device A, all the constituent elements of the first cylindrical body 1 may be integrally molded. In the water discharge switching device B, all the constituent elements of the first cylindrical body 11 may be integrally molded. If all the constituent elements of the first cylindrical body 1, 11 are integrally molded of resin or the like, it is possible to reduce the number of parts and to reduce the manufacturing cost of the water discharge switching device A, B.

In a case where all the constituent elements of the first cylindrical body 1, 11 of the water discharge switching device A, B are integrally molded, it is preferable that the outer edges of the flange-shaped valve seat 1*g*, 11*g* are rounded. Rounding the outer edges of the flange-shaped valve seat 1*g*, 11*g* facilitates pressing the first cylindrical body 1, 11 into the second cylindrical body 2, 12.

The water discharge switching device A, B may be fitted on the discharge port of a hand shower device having a hose that can be pulled out and received and bent. This provides a compact shower device capable of switching the water discharge.

A water discharge switching device in accordance with a third embodiment of the present invention will be described.

Figure 5:
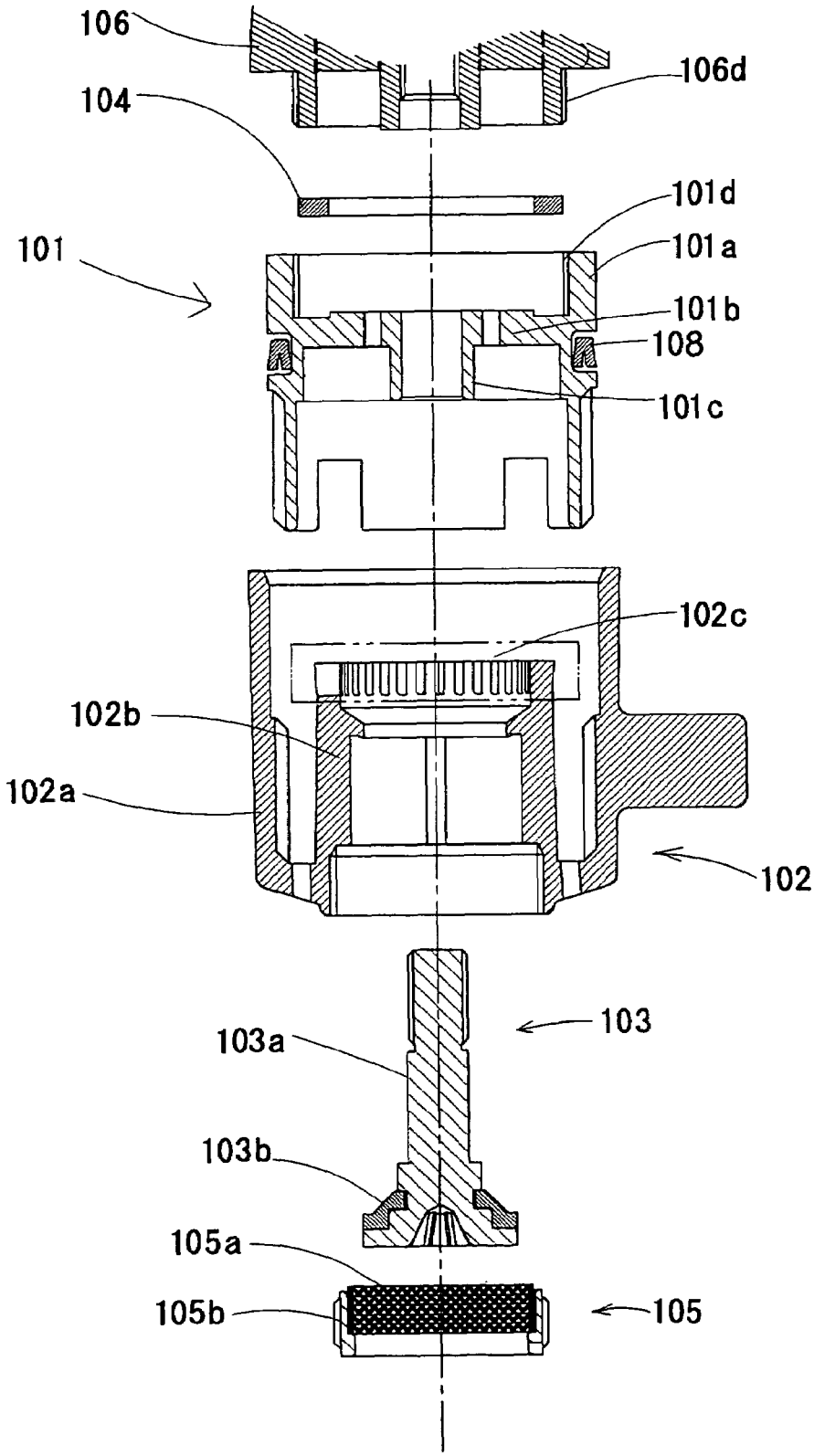
FIG. 5 is a view showing constituent parts of a water discharge switching device in accordance with a third embodiment of the present invention.
Figure 6:
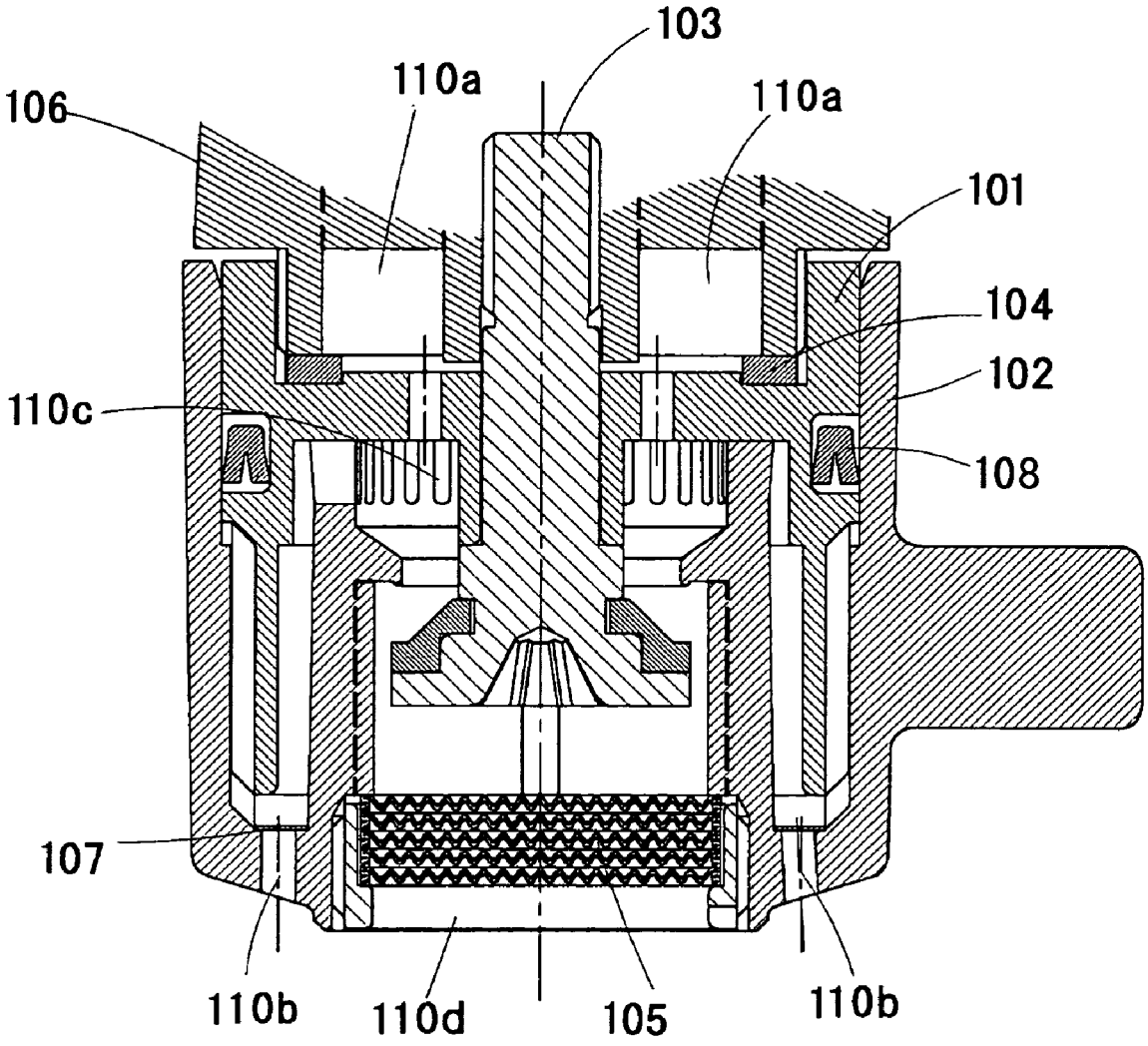
FIG. 6 is a cross-sectional view showing a state of assembly of the water discharge switching device in accordance with the third embodiment of the present invention.

In FIG. 5 are shown constituent parts of an example of a water discharge switching device of the invention and in FIG. 6 is shown a cross-sectional view showing a state in which the water discharge switching device is switched to a state of discharging foaming water.

This water discharge switching device includes a first cylindrical body 101, a second cylindrical body 102, a flange-shaped valve seat 103, a packing 104, a filter part 105, and a U-shaped packing 108, these parts being assembled, and is fitted for use on a faucet hardware unit 106.

A fitting portion 101*a* to be fitted to the faucet hardware unit is formed at one end of the first cylindrical body 101 and a partition wall 101*b* is formed near the fitting portion 101*a*. A pillar-shaped body 101*c* is formed so as to extend in a longitudinal direction from the central portion of the partition wall 101*b* and a plurality of small-diameter holes are made in the partition wall 101*b* in such a way as to surround this pillar-shaped body 101*c*. A spline portion 101*d* is formed on the inner diameter side of the fitting portion 101*a* to be fitted to the faucet hardware unit. Moreover, a spline portion 106*d* to be fitted in the spline portion 101*d* is formed on the faucet hardware unit 106.

The second cylindrical body 102 has an outer cylinder 102*a* and an inner cylinder 102*b* which are concentrically arranged and a top slit portion 102*c* in which slits are formed at regular intervals along a circumferential direction is formed on the top end portion of the inner cylinder 102*b*. The second cylindrical body 102 is screwed on the first cylindrical body 101 such that this top slit portion 102*c* abuts against the bottom surface of the partition wall 101*b* of the first cylindrical body 101.

The flange-shaped valve seat 103 has a packing 103*b* at the bottom peripheral portion of the flange-shaped valve seat body 103*a*. The first cylindrical body 101 and the second cylindrical body 102 are fixed to the faucet hardware unit by the flange-shaped valve seat 103. Further, the filter portion 105 has a filter 105*a* and a filter guide 105*b* and the filter 105*a* can be removed from the filter guide 105*b*.

The first cylindrical body 101, the second cylindrical body 102, the flange-shaped valve seat 103, the packing 104, the filter portion 105, and the U-shaped packing 108 are assembled, as shown in FIG. 6, to form a water flow passage and an air flow passage. A reference symbol 110*a* denotes a water inlet through which water flows from the faucet and 110*b* denotes air suction ports when foaming water is discharged and shower water discharge ports when shower water is discharged. A reference symbol 110*c* denotes an air/water mixing chamber in which water flowing from the water inlet 110*a* is mixed with air sucked from the air suction port 110*b*.

The shower water discharge ports 110*b* serving as the air suction ports, as shown in FIG. 6, can also be formed vertically to a surface provided with the filter 107 and further can also be formed in a manner slightly inclined with respect to a direction vertical to the surface provided with the filter 107.

In this manner, by alternately forming the shower water discharge ports 110*b* formed vertically and the shower water discharge ports 110*b* formed in the manner slightly inclined, the discharge of the shower water can be widened, so that it is possible to increase a feeling of volume of the discharged shower water and thus to realize an improvement in a feeling of cleaning in use.

Figure 7:
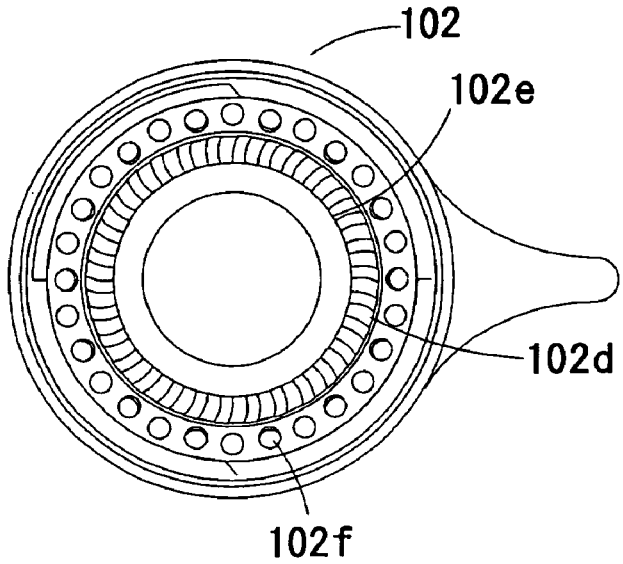
FIGS. 7A and 7B are views showing a construction of a second cylindrical body of the water discharge switching device in accordance with the third embodiment of the present invention.
Figure 7:
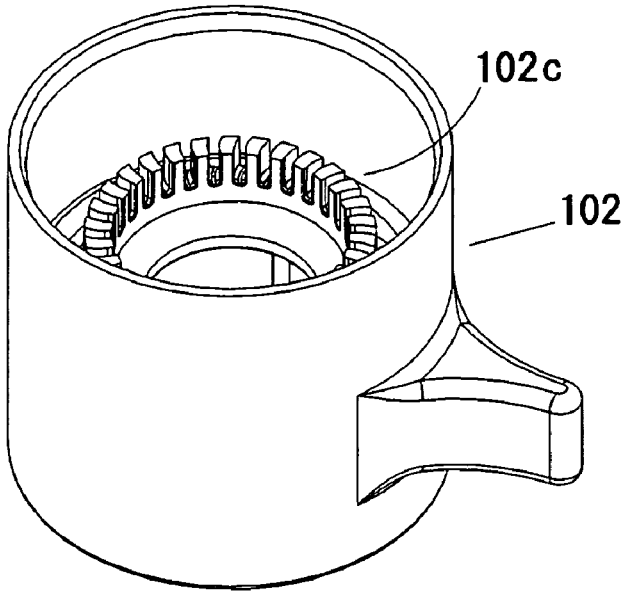

In FIG. 7A is shown a top view of the second cylindrical body 102 and in FIG. 7B is shown a perspective view of the second cylindrical body 102. As shown in FIG. 7A, each slit 102*d* formed on the top slit portion 102*c* is formed in the shape of a fin. By forming each slit in the shape of a fin, it is possible to elongate the length of water flow passage and thus to increase the resistance of water flowing through the water flow passage.

Moreover, it is preferable that the end surface 102*e* on the inner diameter side of the slit 102*d* is formed in a straight line. By forming the end surface 102*e* in the straight line, it is possible to minimize the cross-sectional area of water flowing through the water flow passage and thus to increase the resistance of water flowing through the water flow passage.

By adopting the constitution described above, when the water flowing from the water inlet 110*a* is mixed with the air sucked from the air suction ports 110*b* in the air/water mixing chamber 110*c* and is discharged from the foaming water outlets 110*d*, it is possible to decrease the area of the water flow passage from the air/water mixing chamber 110*c* to the air suction port side and thus to prevent a part of the water flowing from the water inlet 110*a* from flowing backward from the air/water mixing chamber 110*c* to the air suction ports.

This is because the fin-shaped top slit portion 102*c* makes it easy to take air from the air suction ports 110*b* whereas makes it difficult for water from the water inlet 110*a* to pass to the air suction ports because of a difference in viscosity between air and water.

While a case has been described above where slits each formed in the shape of a fin are used as means for reducing the area of the water flow passage, any other shape can be used if the shape can produce a difference between taking air and taking water by the difference in viscosity between air and water.

For example, it is also recommended that a plurality of small holes in the radial direction be formed to penetrate the tip portion of the inner cylinder of the second cylindrical body 102 and the top end surface of this tip portion of the inner cylinder is made to abut against the bottom surface of the partition wall 101*b* of the first cylindrical body 101. By making the cross-sectional area of this small hole smaller than the area of the water flow passage, it is possible to increase the surface tension of the water and thus to prevent the water from leaking to the side of the small shower holes when the foaming water is discharged.

The size and number of the small holes formed in this tip portion of the inner cylinder are determined by the relationship between the small shower holes and the total area of the small shower holes 102*f* serving also as air suction ports 110*b* and, for example, by forming about 64 small holes each having a diameter of about 0.8 mm, it is possible to decrease the area of the water flow passage.

Figure 8:
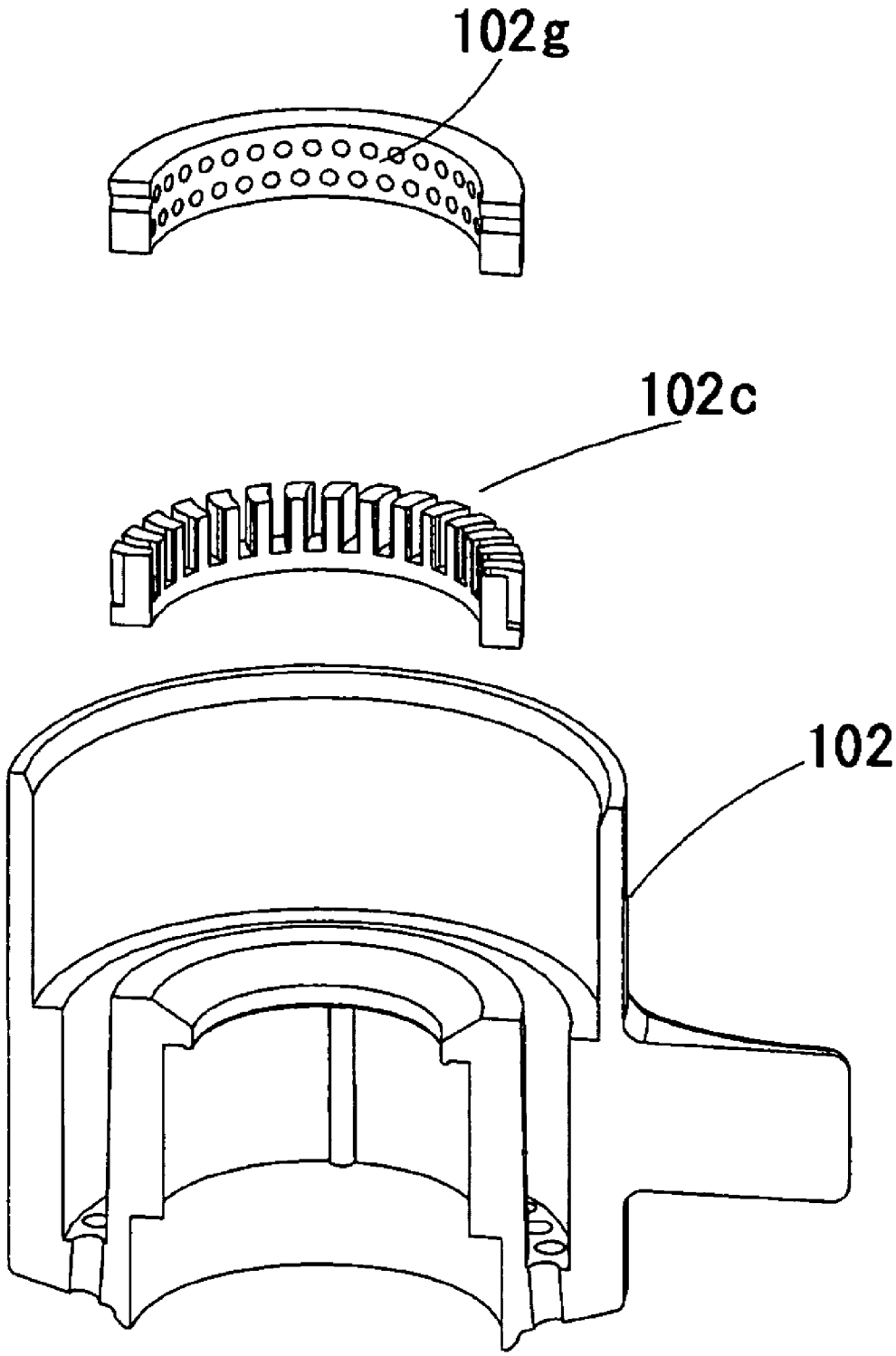
FIG. 8 is a view showing another example of the second cylindrical body of the water discharge switching device in accordance with the third embodiment of the present invention.

FIG. 8 shows a case where the fin-shaped top slit portion or a body having small holes formed therein as means for decreasing the area of the water flow passage is formed as a separate part and where this separate part and the second cylindrical body are used in combination.

As described above, by forming the top slit portion 102*c* or the body 102*g* having small holes formed therein as the separate part, it is possible to replace it according to the circumstances of use and to easily perform maintenance of the part clogged by foreign matters or the like.

The filter 107 can be provided on the air suction ports 110*b*. By providing the filter, it is possible to prevent the leakage of water from the small shower holes by the surface tension of water at the mesh of the filter when the foaming water is discharged. Further, in a case where the shower water is stopped during the discharge of the shower water, it is possible to prevent remaining water from dropping from the shower holes.

A water discharge switching device in accordance with a fourth embodiment of the invention will be described.

FIG. 9A is a cross-sectional view when the foaming water is discharged in the water discharge switching device in accordance with the fourth embodiment of the invention and FIG. 9B is a cross-sectional view when the shower water is discharged in the same water discharge switching device.

Figure 9:
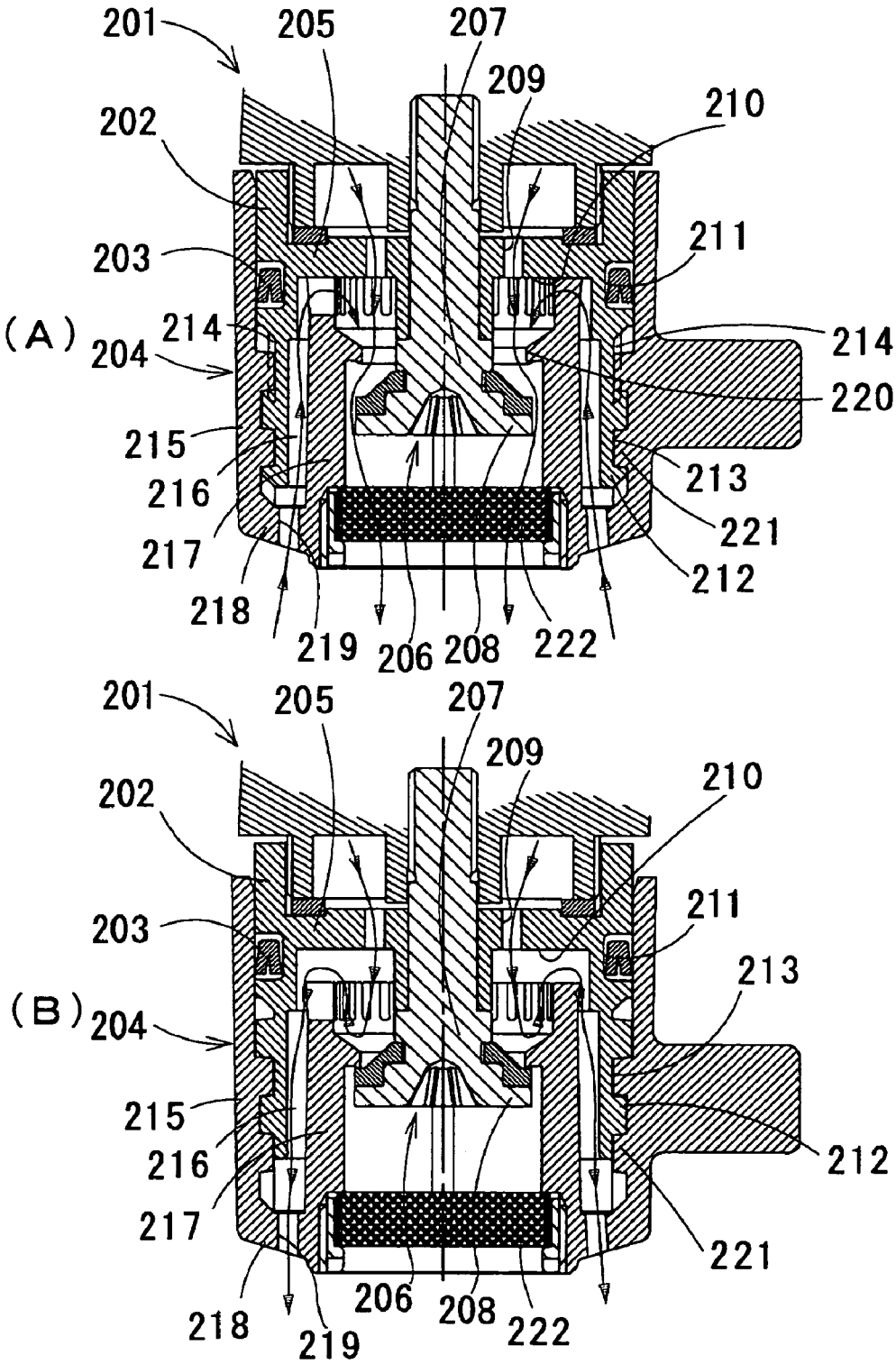
FIGS. 9A and 9B are cross-sectional views of a water discharge switching device in accordance with a fourth embodiment of the present invention.

As shown in FIG. 9, a water discharge switching device 201 is a device in which a second cylindrical body 204 is arranged via an annular U-shaped packing 203 outside a first cylindrical body 202 in which water is passed, the first cylindrical body 202 is screwed in the second cylindrical body 204, and water flow passages in the first cylindrical body 202 are opened and closed by turning the second cylindrical body 204 to switch to the other water flow passage.

A partition wall 205 for dividing the inside of the first cylindrical body 202 into two parts in the direction of flow is provided in the first cylindrical body 202 and a flange-shaped valve seat 206 shaped like a letter T in cross section is provided on the downstream side of the central portion of the partition wall 205. The flange-shaped valve seat 206 has a cylindrical portion 207 and a flange portion 208 formed at the bottom end portion of the cylindrical portion 207 and having an enlarged diameter.

Many water passing holes 209 are formed at the position where the central portion of the partition wall 205 overlaps the flange portion 208 when viewed from the top.

The downstream end surface of the partition wall 205 also serves as a stopper portion 210. The stopper portion 210 can stop the second cylindrical body 204 by making the upstream end portion of an inner cylinder 217 of the second cylindrical body 204 abut against the stopper portion 210. The U-shaped packing 203 is fitted in an annular groove 211 formed in a middle portion in the direction of flow on the outer peripheral surface of the first cylindrical body 202.

Figure 10:
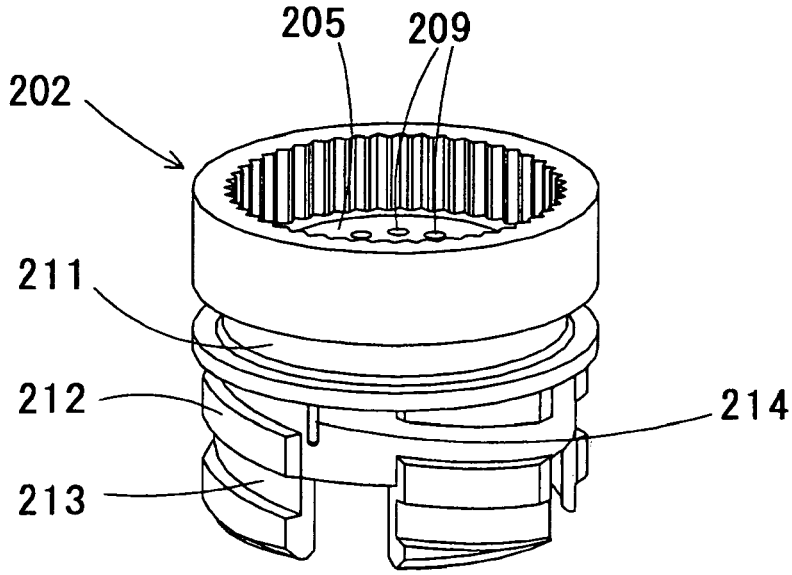
FIG. 10 is a view showing a first cylindrical body of the water discharge switching device in accordance with the fourth embodiment of the present invention.

FIG. 10 is a perspective view of the first cylindrical body 202.

An external thread portion 212 is formed on the downstream side from the annular groove 211 of the first cylindrical body 202. The external thread portion 212 is formed in the shape of a trapezoid or a rectangle in cross section and a protrusion 214 which is circular in cross section is formed on the upstream end portion of a screw bottom portion 213 of the external thread portion 212.

The external thread portion 212 is cut at predetermined intervals to reduce sliding resistance when it is screwed into the second cylindrical body.

Figure 11:
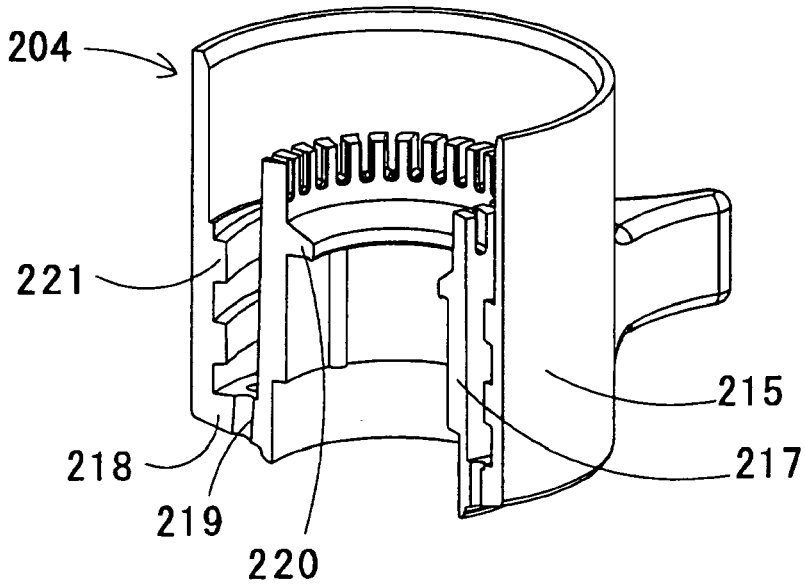
FIG. 11 is a view showing a second cylindrical body of the water discharge switching device in accordance with the fourth embodiment of the present invention.

FIG. 11 is a perspective cross-sectional view of the second cylindrical body.

The second cylindrical body 204 has an outer cylinder 215 arranged outside the first cylindrical body 202 and an inner cylinder 217 arranged inside the first cylindrical body 202 with a gap 216 therebetween. The downstream end portion of the outer cylinder 215 is connected to that of the inner cylinder 217 by an end plate 218 formed in the shape of a ring. Many jet holes 219 are made in the end plate 218.

An annular valve body 220 is formed in an inwardly protruding manner on the inner periphery of the inner cylinder 217. The annular valve body 220 is arranged at a position where it can abut against the outer peripheral portion of the flange-shaped valve seat 206 from the upstream side.

The upstream end portion of the inner cylinder 217 is formed in the shape of teeth of a comb parallel to the direction of water flow and many grooves passing through in the radial direction are formed at equal intervals between the teeth.

Further, at the downstream end portion of the inner periphery of the inner cylinder 217 is provided a depression where a circular filter 222 for removing foreign matters and at the same time for mixing air and water to discharge foaming water is mounted.

An internal thread portion 221 that can be screwed on the external thread portion 212 of the first cylindrical body 202 is formed on the downstream side of the inner periphery of the outer cylinder 215.

The internal thread portion 221 is formed in the shape of a trapezoid or a rectangle in cross section, as is the case with the external thread portion 212.

Figure 12:
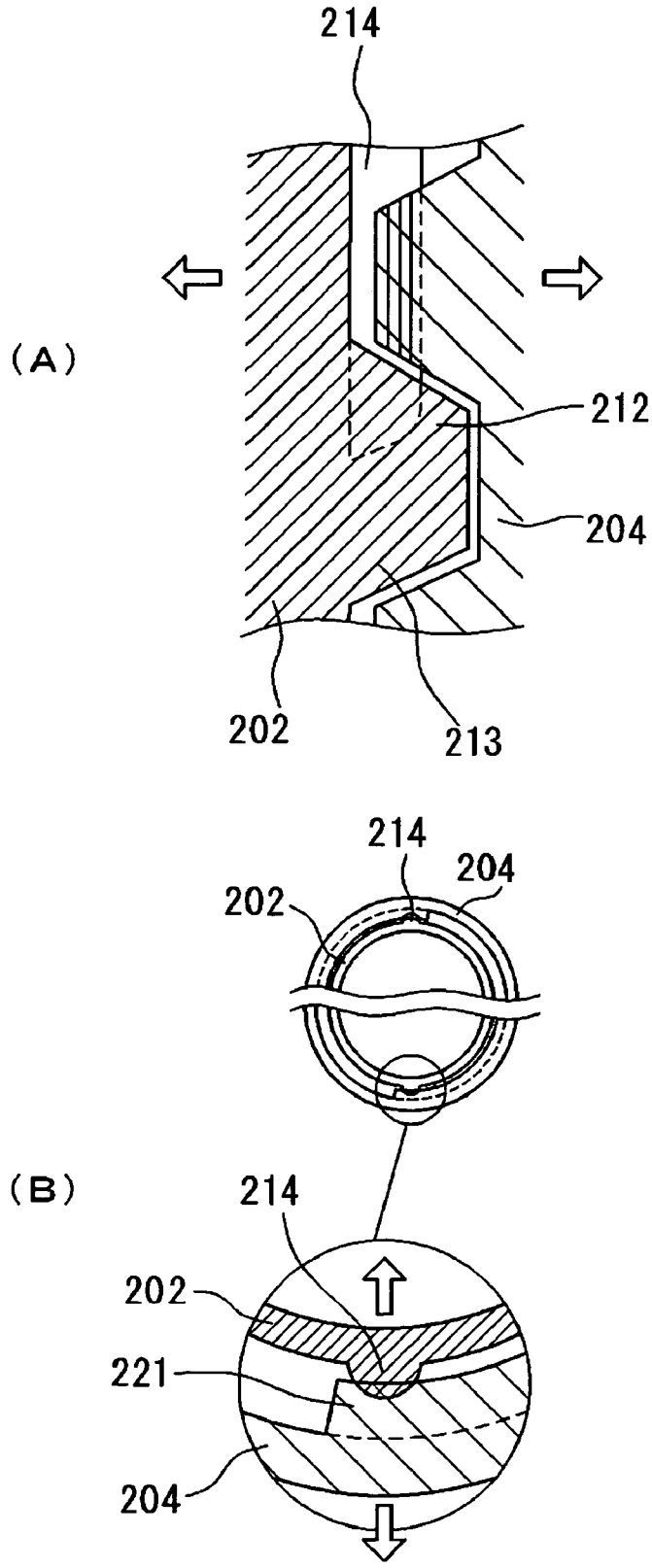
FIG. 12A is a cross-sectional view showing a state where an external thread portion is screwed into an internal thread portion in the water discharge switching device in accordance with the fourth embodiment of the present invention.
FIG. 12B is a cross-sectional view showing a state where the internal thread portion and external thread portion screwed therein are cut in a spiral manner.

FIG. 12A is a cross-sectional view showing a state where the external thread portion is screwed in the internal thread portion and FIG. 12B is a cross-sectional view showing a state where the internal thread portion and the external thread portion screwed therein are cut in the shape of a spiral.

The protrusion 214 formed in the shape of an arc in cross section is arranged in the shape of a straight line along the direction of water flow on the bottom of a groove adjacent to the end of the external thread portion 212 and its tip is formed in the shape of a semisphere. Since the internal thread portion 221 is formed in the shape of a trapezoid or a rectangle in cross section, its crest is formed in the shape of a straight line in cross section to prevent its crest from being crushed by the protrusion 214.

In this respect, it is possible to increase force necessary for climbing over the protrusion 214 by increasing the height of the protrusion 214, and also to adjust the force necessary for climbing over the protrusion 214 by decreasing the height of the protrusion 214.

Further, it is possible to decrease the force necessary for climbing over the protrusion 214 by narrowing the width of the tip portion of the internal thread portion 221 and further to adjust the force necessary for climbing over the protrusion 214 by gradually decreasing the width of the tip portion as the position is nearer to the tip.

As shown in FIG. 12B, the external thread portion 212 and the internal thread portion 221 are formed in a double thread and the protrusions 214 are arranged opposite to each other across the center of the first cylindrical body 202.

Thus, the upstream end portion of the internal thread portion 221 abuts against and climbs over two protrusions 214. At this time, the internal thread portion 221 receives force outward in the radial direction from the protrusions 214 and the outer cylinder 215 of the second cylindrical body 204 is slightly deformed to make an abutting portion bulge. Moreover, the protrusion 214 receives force inward in the radial direction and the first cylindrical body 202 is slightly deformed to make the protrusion 214 contract inward. Since the protrusions 214 are formed at the two positions opposite to each other, the central position of the first cylindrical body 202 is not shifted from that of the second cylindrical body 204.

As shown in FIG. 9B, if the second cylindrical body 204 is turned in the direction that loosens the second cylindrical body 204 with respect to the first cylindrical body 202, the annular valve body 220 of the second cylindrical body 204 abuts against the outer peripheral portion of the flange-shaped valve seat 206. Water passing through the first cylindrical body 202 flows into the inner cylinder 217 from the water passing holes 209 of the partition wall 205, passes through the grooves between the teeth of the comb formed on the upstream end portion of the inner cylinder 217, a gap formed between the upstream end portion of the inner cylinder 217 and the downstream end portion of the partition wall 205, and a gap 216 formed between the inner cylinder 217 and the first cylindrical body 202, and is jetted out as shower water from the jet ports 219 of the end plate 218.

As shown in FIG. 9A, if the second cylindrical body 204 is turned in the direction that fastens the second cylindrical body 204 with respect the first cylindrical body 202, the internal thread portion 221 of the second cylindrical body 204 abuts against the protrusions 214 of the first cylindrical body and climbs over the protrusions 214. Then, the upstream end portion of the inner cylinder 217 of the second cylindrical body 204 abuts against the stopper portion 210 of the first cylindrical portion 202 and stops there. A turn angle from the time when the second cylindrical body 204 abuts against the protrusions 214 to the time when it abuts against the stopper portion 210 is set at about 3 degrees.

In the state shown in FIG. 9A, the annular valve body 220 of the second cylindrical body 204 is separated from the outer peripheral portion of the flange-shaped valve seat 206.

Water passing through the first cylindrical body 202 in this state flows inside the inner cylinder 217 from the water passing holes 209 formed in the partition wall 205. Then, the water flows in from the jet holes 219 of the end plate 218, passes through the gap 216 between the inner cylinder 217 and the first cylindrical body 202, involves air climbing over the upstream end portion of the inner cylinder 217 and entering inside, then passes through the gap between the flange-shaped valve seat 206 and the annular valve body 220, and is jetted out as foaming water through the filter 222.

The second cylindrical body 204 is held by a frictional force between the external thread portion 212 and the internal thread portion 221, a frictional force between the protrusions 214 and the internal thread portion 221, and a frictional force among the second cylindrical body 204 and the first cylindrical body 202 and the U-shaped packing 203, so that the second cylindrical body 204 is never turned in reverse and loosened by itself.

Figure 13:
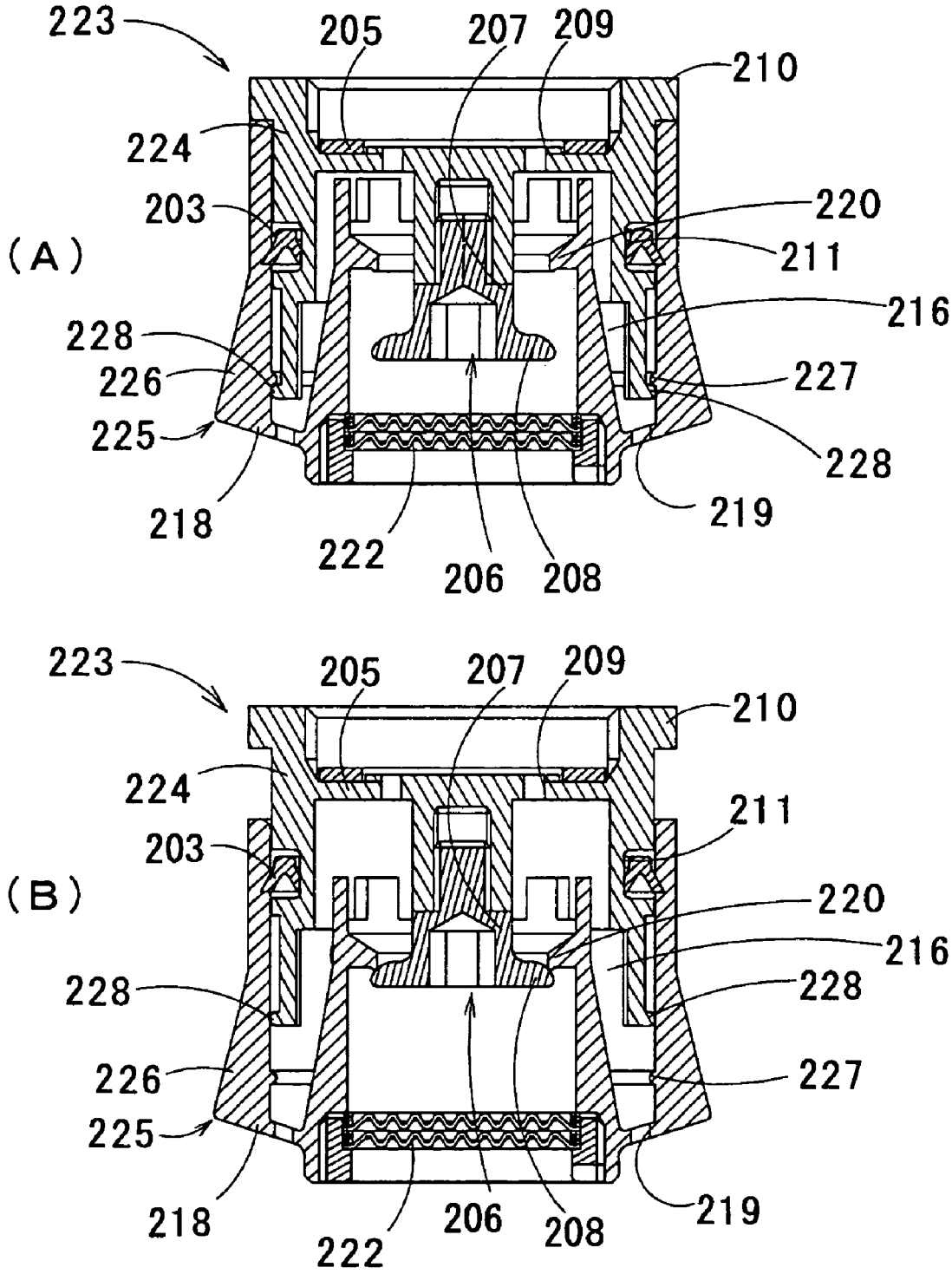
FIG. 13A is a cross-sectional view when foaming water is discharged in a water discharge switching device in accordance with a fifth embodiment of the present invention.
FIG. 13B is a cross-sectional view when shower water is discharged in the same water discharge switching device.

FIG. 13A is a cross-sectional view when foaming water is discharged in a water discharge switching device in accordance with a fifth embodiment of the invention and FIG. 13B is a cross-sectional view when shower water is discharged in the same water discharge switching device.

A water discharge switching device 223 has a structure in which a first cylindrical body 224 and a second cylindrical body 225 are moved in parallel to the direction of water flow, and the structure of water passage thereof is the same as that of the water discharge switching device 1 in accordance with the fourth embodiment described above, so that the parts having the same structures are denoted by the same reference symbols and their descriptions will be omitted.

An annular protrusion 227 circular in cross section is formed on the downstream end portion of the outer cylinder 226 of the second cylindrical body 225.

Moreover, semispherical protrusions 228 are formed at predetermined intervals on the downstream end portion of the outer periphery of the first cylindrical body 224. The protrusions 228 and the annular protrusion 227 are arranged in such a way that they can climb over each other.

Here, one or both the second cylindrical body 225 and the first cylindrical body 224 is or are provided with a guide portion for guiding the relative movement of the second cylindrical body 225 and the first cylindrical body 224 in the direction of water flow.

As shown in FIG. 13A, when the foaming water is jetted out, the second cylindrical body 225 is arranged on an upper side.

When the second cylindrical body 225 is moved upward from a position shown in FIG. 13B, the annular protrusion 227 of the second cylindrical body 225 abuts against the protrusions 228 of the first cylindrical body 224. Then, when the second cylindrical body 225 is further moved upward, the annular protrusion 227 is brought into a state where it climbs up the protrusions 228 and then into a state where it climbs over the protrusions 228.

Until the annular protrusion 227 abuts against the protrusions 228, a given frictional resistance is applied by the U-shaped packing 203, and then when the annular protrusion 227 climbs up the protrusions 228, the frictional resistance suddenly increases and after the annular protrusion 227 climbs over the protrusions 228, the frictional resistance suddenly decreases. That is, an operator can feel a click.

At this time, the upstream end of the second cylindrical body 225 abuts against the stopper portion 210 of the first cylindrical body 224 and can not move further.

Here, the stopper can be formed as a part of the first cylindrical body 224 or can be formed as a part separate from the first cylindrical body 224 and this part can be mounted for use on the first cylindrical body 224. Alternatively, the stopper may be formed by the end surface on the upstream side of the second cylindrical body 225 and the main body.

When water is allowed or made to flow in this state, hydraulic pressure is applied to the annular valve body 220 of the second cylindrical body 225 and the filter 222, but because the annular protrusion 227 is brought into a state where it climbs over the protrusions 228, the second cylindrical body 225 can not move to the downstream side.

When shower water is discharged, the second cylindrical body 225 is moved upstream from the state shown in FIG. 13A.

When the annular protrusion 227 climbs over the protrusions 228, a large force is required but after it climbs over, the second cylindrical body 225 can be easily moved by applying force resisting to a given frictional resistance caused by the U-shaped packing 203.

When water is flowed in this state, the shower water can be jetted.

In this respect, in the fourth and fifth embodiments, the protrusion may be formed also at two positions of the upstream end portion and the downstream end portion. This constitution can make operational forces required for switching the water discharge in two directions equal to each other.

Figure 14:
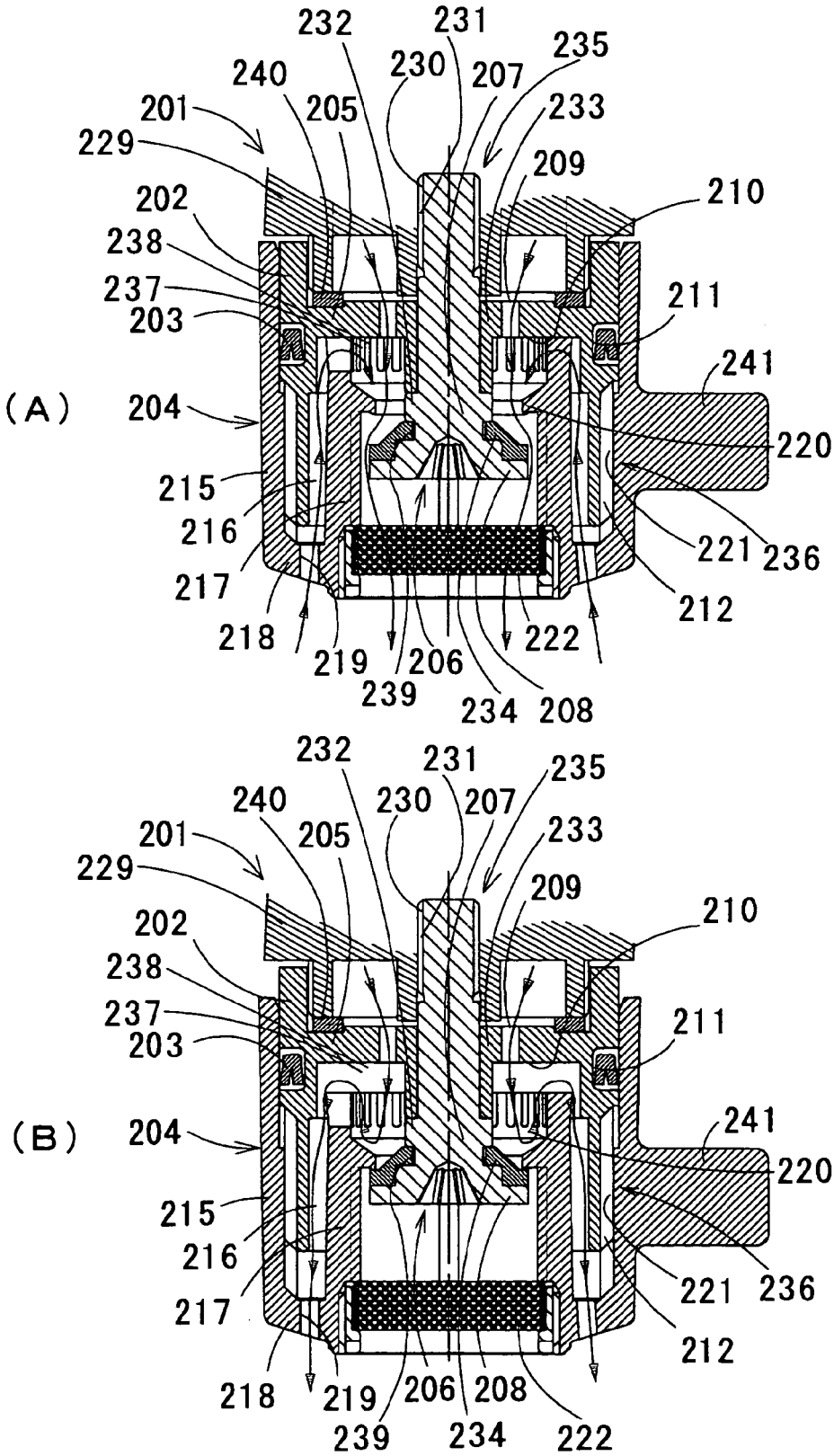
FIG. 14A is a cross-sectional view when foaming water is discharged in a water discharge switching device in accordance with a sixth embodiment of the present invention.
FIG. 14B is a cross-sectional view when shower water is discharged in the same water discharge switching device.

FIG. 14A is a cross-sectional view when foaming water is discharged in a water discharge switching device in accordance with a sixth embodiment of the invention, and FIG. 14B is a cross-sectional view when shower water is discharged in the same water discharge switching device.

A water discharge switching device 201 is a device in which there is arranged the second cylindrical body 204 having the inner cylinder 217 inside the first cylindrical body 202 in which water is flowed and the outer cylinder 215 having the annular U-shaped packing 203 outside the first cylindrical body 202, the first cylindrical body 202 is screwed into the outer cylinder 215 of the second cylindrical body 204, and the second cylindrical body 204 is turned to open or close a first flow passage inside the inner cylinder 217 of the first cylindrical body 202 to thereby switch between the discharge of the foaming water and the discharge of the shower water.

In the first cylindrical body 202, the partition wall 205 for dividing the inside of the first cylindrical body 202 into two portions in the direction of the water flow is provided, and the flange-shaped valve seat 206 shaped like a letter T in cross section is provided on the downstream side of the central portion of the partition wall 205. The flange-shaped valve seat 206 has a cylindrical portion 207 and a flange portion 208 formed at the bottom end of the cylindrical portion 207 and having an enlarged diameter.

An external thread portion 230 is formed on the upstream end portion of the cylindrical portion 207 of the flange-shaped valve seat 206. The external thread portion 230 is connected to the cylindrical portion 207 at its base side end and is not provided with a portion having a contracted diameter.

There is also a case where water flowing through the water flow passage is warm water and thus a load applied to the external thread portion 230 is increased by heat and the hydraulic pressure. However, the base side end of the external thread portion 230 is directly connected to the cylindrical portion 207 and thus the above-mentioned base side end is prevented from being degraded or broken by a stress concentration.

The external thread portion 230 is passed through a cylindrical sleeve portion 233 formed in the central portion of the partition wall 205 and is screwed in the internal thread portion 231 of the main body 229 fitted in the upstream side of the first cylindrical body 202. A first screw assembly 235 is constituted by the external thread portion 230 and the internal thread portion 231.

Moreover, a stepped portion 232 having a diameter larger than the inner diameter of the sleeve portion 233 is formed at the middle portion of the cylindrical portion 207 protruding downward from the sleeve portion 233 and the sleeve portion 233 is fixed to the main body 229 by this stepped portion 232. Here, a sealing ring 240 is arranged between the main body 229 and the first cylindrical body 202.

An annular groove 239 having a rectangular cross section is formed on the whole periphery of the middle portion of the stepped portion 232.

A sealing member 234 made of a rubber-based material having elasticity and being watertight is provided on the upstream side surface of the flange portion 208 of the flange-shaped valve seat 206.

The outer diameter of the sealing member 234 is equal to the outer diameter of the flange portion 208. Moreover, the inner peripheral potion of the sealing member 234 is fitted in the annular groove 239.

The side surface on the upstream side of the sealing member 234 is formed in an inclined surface shaped like a cone on its inner side and is formed in a horizontal annular surface 236 on its outer side.

Many water flowing holes 209 are formed at the position where the central portion of the partition wall 205 overlaps the inclined surface of the flange portion 208 when viewed from the top.

The downstream end surface of the partition wall 205 also serves as the stopper portion 210 of the second cylindrical body 204. The stopper portion 210 can stop the second cylindrical body 204 by making the upstream end portion of the inner cylinder 217 abut against the stopper portion 210.

An engaging groove shaped like a symbol + the center of which is at the same position as the external thread portion 230 is formed on the bottom surface of the flange portion 208. The flange-shaped valve seat 206 can be turned by the use of a tool such as a commercially available screwdriver and be readily assembled and maintained. Here, the shape of the engaging groove may be formed in the shape of—or a hexagon.

A tapered portion (not shown) for guiding water passing by the flange portion 208 in the central direction of the water flow is formed on the whole periphery of the downstream corner portion of the outer periphery of the flange portion 208.

The U-shaped packing 203 is fitted in the annular groove 211 formed at the middle portion in the direction of the water flow on the outer peripheral surface of the first cylindrical body 202.

The external thread portion 212 is formed on the downstream side from the U-shaped packing 203 on the outer peripheral surface of the first cylindrical body 202.

The internal thread portion 221 to be screwed on the external thread portion 212 of the first cylindrical body 202 is formed on the downstream side of the inner periphery of the outer cylinder 215 of the second cylindrical body 204. The inner cylinder 217 of the second cylindrical body 204 is arranged inside the first cylindrical body 202 with the gap 216 therebetween to thereby form an air/water mixing chamber on the upstream side inside the inner cylinder 217 and a first water passage on the downstream side inside the inner cylinder 217, and a second water passage communicating with the above-mentioned air/water mixing chamber outside the inner cylinder 217. The downstream end portions of the outer cylinder 215 and the inner cylinder 217 are connected to each other by the end plate 218 formed in the shape of a ring. Many jet holes 219 are formed, nearly in the direction of the water flow, through the end plate 218.

The external thread portion 212 of the first cylindrical body 202 and the internal thread portion 221 of the second cylindrical body 204 constitute a second screw assembly 236. Here, a lever 241 is provided on the outer periphery of the outer cylinder 215.

An annular valve body 220 is provided in an inwardly protruding manner at the middle portion of the inner periphery of the inner cylinder 217 at the boundary portion of the air/water mixing chamber and the first flow passage. The annular valve body 220 is arranged at a position where it can abut against the outer peripheral portion of the flange-shaped valve seat 206 from the upstream side.

Many comb teeth 237 parallel to the direction of the flow are formed on the upstream end portion of the inner cylinder 217 and many grooves 238 are formed through in the radial direction at equal intervals between the teeth of the comb 237.

Moreover, a circular filter 222 for removing foreign matter, mixing air and water, and further straightening foaming water is provided on the downstream end portion of the inner periphery of the inner cylinder 217.

Since a first screw assembly 235 and a second screw assembly 236 are concentrically arranged, the device can be readily assembled only by fastening the two assemblies. In particular, the second screw assembly 236 is an operational part and can be manually fastened, so that it is only one part of the first screw assembly 235 that requires a tool. Thus, this improves the workability of assembling them.

The turning direction when the second screw assembly 236 is fastened is set opposite to the turning direction when the first screw assembly 235 is fastened.

For example, assuming that the external thread portion 230 of the flange-shaped valve seat 206 and the internal thread portion 231 of the main body 229 are a right hand screw, by turning the flange-shaped valve seat 206 in a clockwise direction, the flange-shaped valve seat 206 can be fastened to the main body 229.

Moreover, in this case, the second screw assembly 236 is a left hand screw, so that if the second cylindrical body 204 is turned in an anticlockwise direction, it is moved to the upstream side, as shown in FIG. 14A, and if turned in a clockwise direction, it is moved to the downstream side, as shown in FIG. 14B.

In this respect, also in a case where the second screw assembly is formed inside the first cylindrical body and is directly screwed on the inner cylinder, the operation is the same.

In the state shown in FIG. 14A, the annular valve body 220 of the second cylindrical body 204 is separated from the outer peripheral portion of the flange-shaped valve seat 206.

Water passing through the first cylindrical body 202 in this state flows into the air/water mixing chamber inside the inner cylinder 217 from the water passing holes 209 of the partition wall 205. Then, the water flows in from outside the jet holes 219 of the end plate 218, passes through the second flow passage that is the gap 216 between the inner cylinder 217 and the first cylindrical body 202, involves air passing through the groove 238 of the inner cylinder 217 into the inside air/water mixing chamber, then passes through between the flange-shaped valve seat 206 and the annular valve body 220, and is jetted out as foaming water via the filter 222. At this time, the side surface on the upstream side of the sealing member 234 provided on the flange-shaped valve seat 206 is formed in the shape of a cone, so that the water flow is smoothly widened outward to reduce a pressure loss. For this reason, water remaining in a space on the upstream side of the flange-shaped valve seat 206 becomes small in quantity and easily flows to the downstream side to reduce a force caused by hydraulic pressure applied to the flange-shaped valve seat 206, which results in reducing a load applied to the first screw portion 235.

As shown in FIG. 14B, when the second cylindrical body 204 is turned in the clockwise direction with respect to the first cylindrical body 202, the annular valve body 220 of the second cylindrical body 204 abuts against the side top surface of the sealing member 234 provided on the flange-shaped valve seat 206 to close the first flow passage. Water flowing in the first cylindrical body 202 flows from the water passing holes 209 of the partition wall 205 into the air/water mixing chamber inside the inner cylinder 217, passes via the grooves 238 between the teeth of the comb 237 of inner cylinder 217 and the gap formed between the upstream end portion of the inner cylinder 217 and the downstream side of the partition wall 205 through the second flow passage, which is the gap 216 between the inner cylinder 217 and the first cylindrical body 202, and is jetted out as the shower water from the jet holes 219 of the end plate 218.

At this time, the annular valve body 220 presses the side upper surface of the flange-shaped valve seat 206 to the downstream side while it is turning in the clockwise direction. Since the sealing member 234 having elasticity is provided on the upper surface of the flange-shaped valve seat 206, force applied to the downstream side is absorbed by the sealing member 234 and torque turning in the clockwise direction is slightly applied to the flange-shaped valve seat 206. Since the external thread portion 230 of the flange-shaped valve seat 206 is a right hand screw, the flange-shaped valve seat 206 is slightly fastened and is prevented from being loosened.

Figure 15:
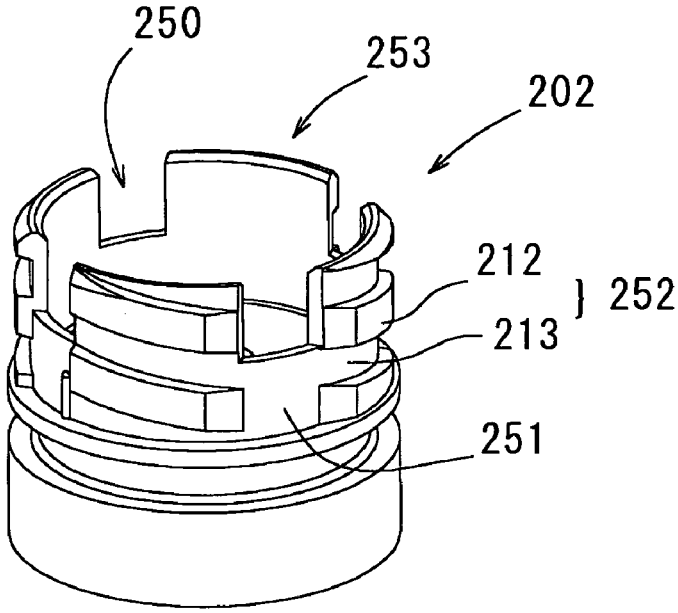
FIG. 15 is a view showing a first cylindrical body having non-threaded portions provided on an outer periphery thereof in the water discharge switching device in accordance with the sixth embodiment of the present invention.

FIG. 15 is a view, shown upside down, of the first cylindrical body 202 shown in FIG. 10.

The first cylindrical body 202 is provided with a plurality of notches 250 and there are provided not-threaded portions 251 each of which continues to each of the notch 250 and is not threaded. Thus, in this first cylindrical body 202, a screw portion 252 including the external thread portion 212 and the screw bottom portion 213 is formed in a state where it is divided into a plurality of portions with respect to the outer periphery of the first cylindrical body 202.

The first cylindrical body 202 is manufactured by a die molding. When the first cylindrical body 202, which is a molded product, is taken out of a die, if the screw portion 252 is formed on the whole periphery of the first cylindrical body 202, the screw portion is caught on the die. Thus, the first cylindrical body 202 is required to be molded by the use of a die to be divided into many pieces.

The first cylindrical body 202 in accordance with the present embodiment has the not-threaded portions formed periodically on the outer periphery of the first cylindrical body 202, so that when the first cylindrical body 202 is taken out of the die, it can be less caught on the die. For this reason, this can reduce the number of divided pieces of the die and thus improve molding performance. Moreover, this can shorten a time necessary for a molding process and thus realize a reduction in manufacturing cost.

The above-mentioned not-threaded portions can be formed also by extending the notches 250 to the positions of the not-threaded portions 251. However, in this case, not only the strength of the first cylindrical body 202 is reduced but also the tip portion 253 of the first cylindrical portion 202 is easily bent by a thermal contraction when it is molded, which tends to produce a trouble when it is fitted in the second cylindrical body. For this reason, it is preferable that, like the present embodiment, the not-threaded portions 251 continuing to the notches 250 and having thickness are provided.

Figure 16:
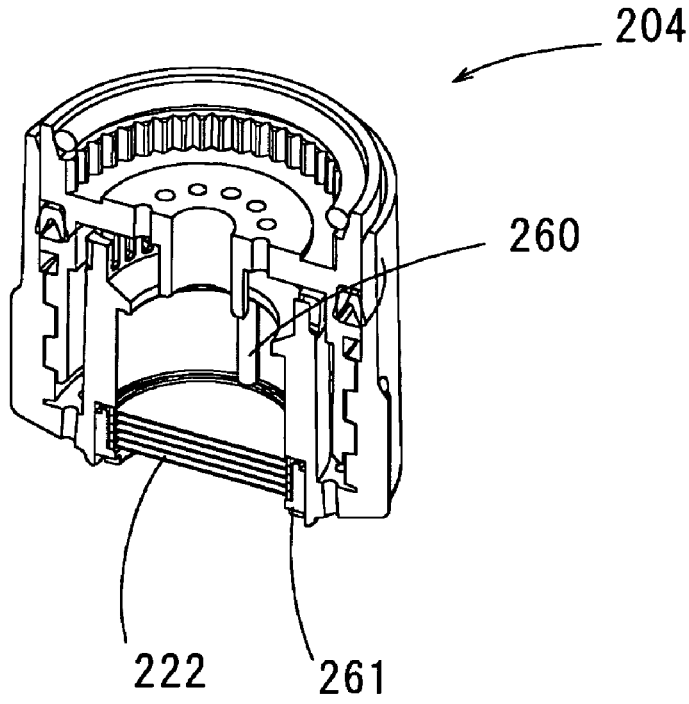
FIG. 16 is a view showing a second cylindrical body having a rib for pressing a filter provided thereon in the water discharge switching device in accordance with the sixth embodiment of the present invention.

FIG. 16 shows a state where the filter 222 provided at the foaming water outlets is pressed and fixed by a plurality of ribs 260 provided in the second cylindrical body 204.

By fixing the filter 222 by the plurality of ribs 260, it is possible to ensure the cross-sectional area of a water flow passage and to prevent the turbulence of discharged water and the occurrence of noise caused by flutter of the filter 222 when the foaming water is discharged.

Incidentally, the filter 222 can be removed from a filter guide 261, so when dust remains on the filter 222, it is possible to easily remove the filter 222 from the filter guide 261 and to clear the dust from the filter 222.

Figure 17:
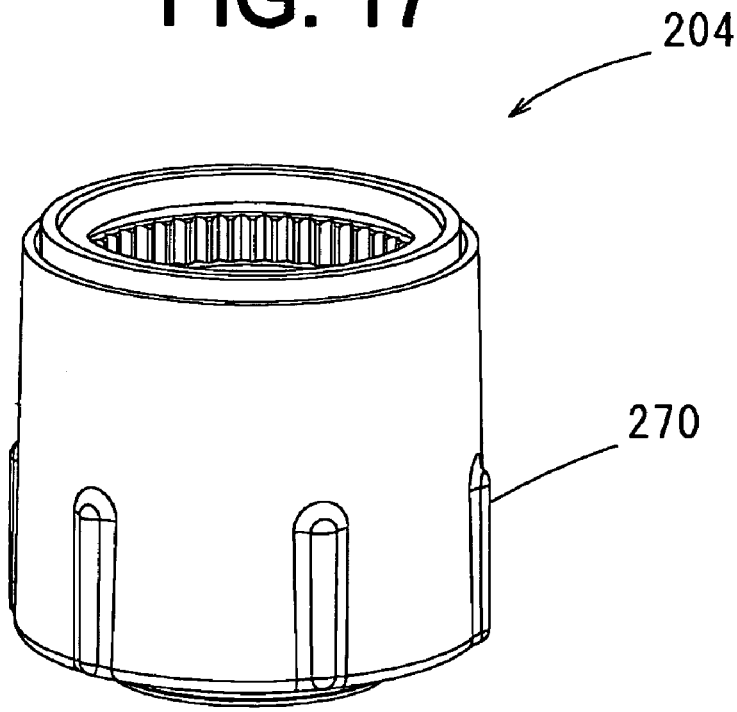
FIG. 17 is a view showing a second cylindrical body having protrusions provided on an outer periphery thereof in the water discharge switching device in accordance with the sixth embodiment of the present invention.

FIG. 17 shows an example in which protrusions 270 are provided at regular intervals on the outer periphery of the second cylindrical body 204.

It is also possible to provide a lever for operating the second cylindrical body 204 on the outer periphery of the second cylindrical body 204. However, by providing the protrusions 270 like this example, it is possible to assemble the second cylindrical body 204 irrespective of the directivity, which is different from a case where the lever is provided, and thus to improve workability in assembling. Moreover, even if the second cylindrical body 204 is operated with wet hands, the hands are hard to slip. Therefore, this can improve operability.

A water discharge switching device in accordance with a seventh embodiment of the invention will be described.

The embodiment for improving the operability of switching the water discharge will be described based on FIG. 18 to FIG. 21.

Figure 18:
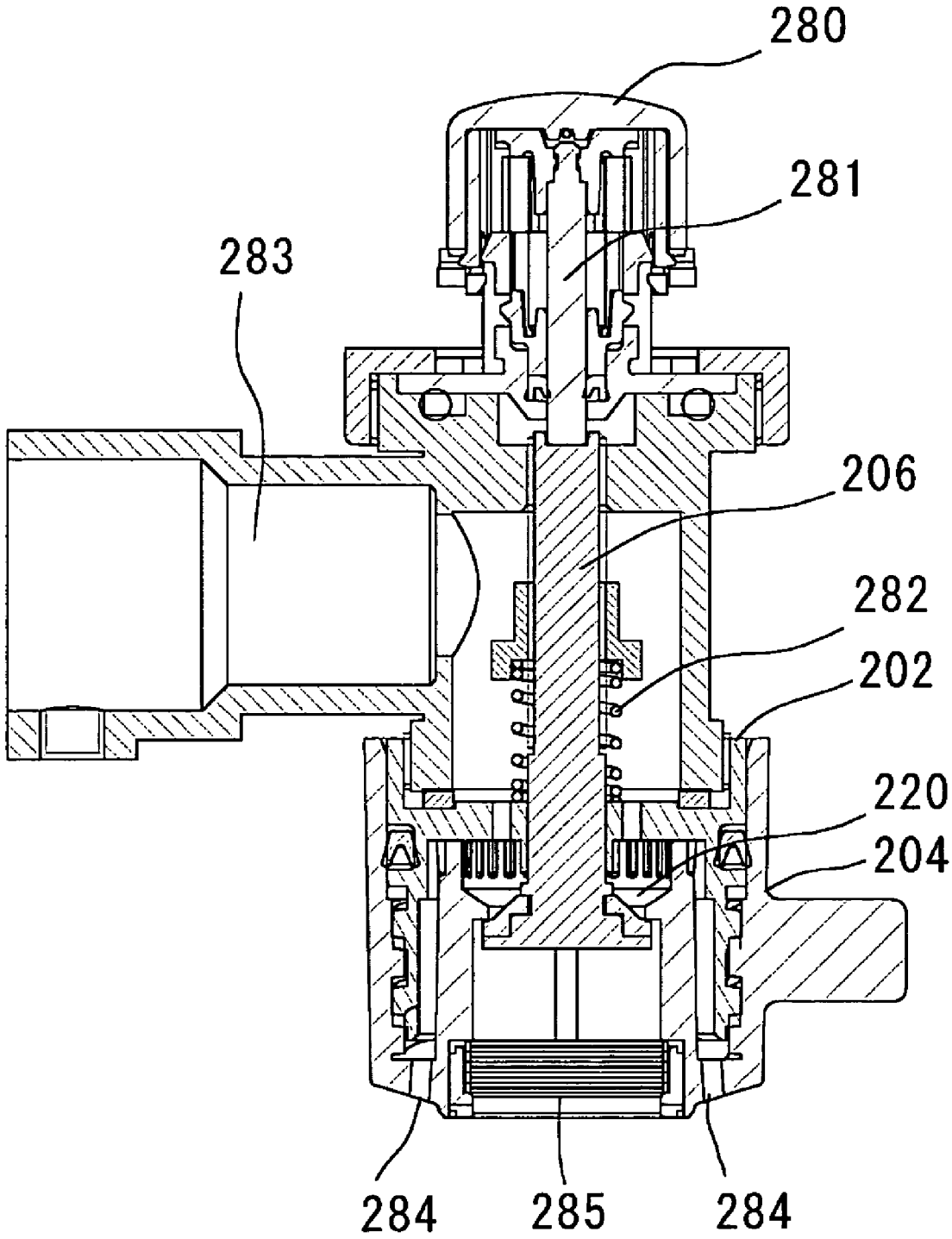
FIG. 18 is a cross-sectional view of a water discharge switching device in accordance with a seventh embodiment of the present invention and is a view showing a state where shower water is discharged.

In FIG. 18, the second cylindrical body 204 is fitted on the first cylindrical body 202 to form the water discharge switching device and in this embodiment, a switching bar 281 provided in a switching button 280 abuts against the top end of the flange-shaped valve seat 206. A spring 282 is provided on a part of the outer periphery of the flange-shaped valve seat 206.

In FIG. 18, the downstream outer peripheral portion of the flange-shaped valve seat 206 abuts against the annular valve body 220 of the second cylindrical body 204. Thus, in this case, water flowing into through a water inlet 283 flows out through a shower water discharge port 284 and is brought into a state of discharging the shower water.

Figure 19:
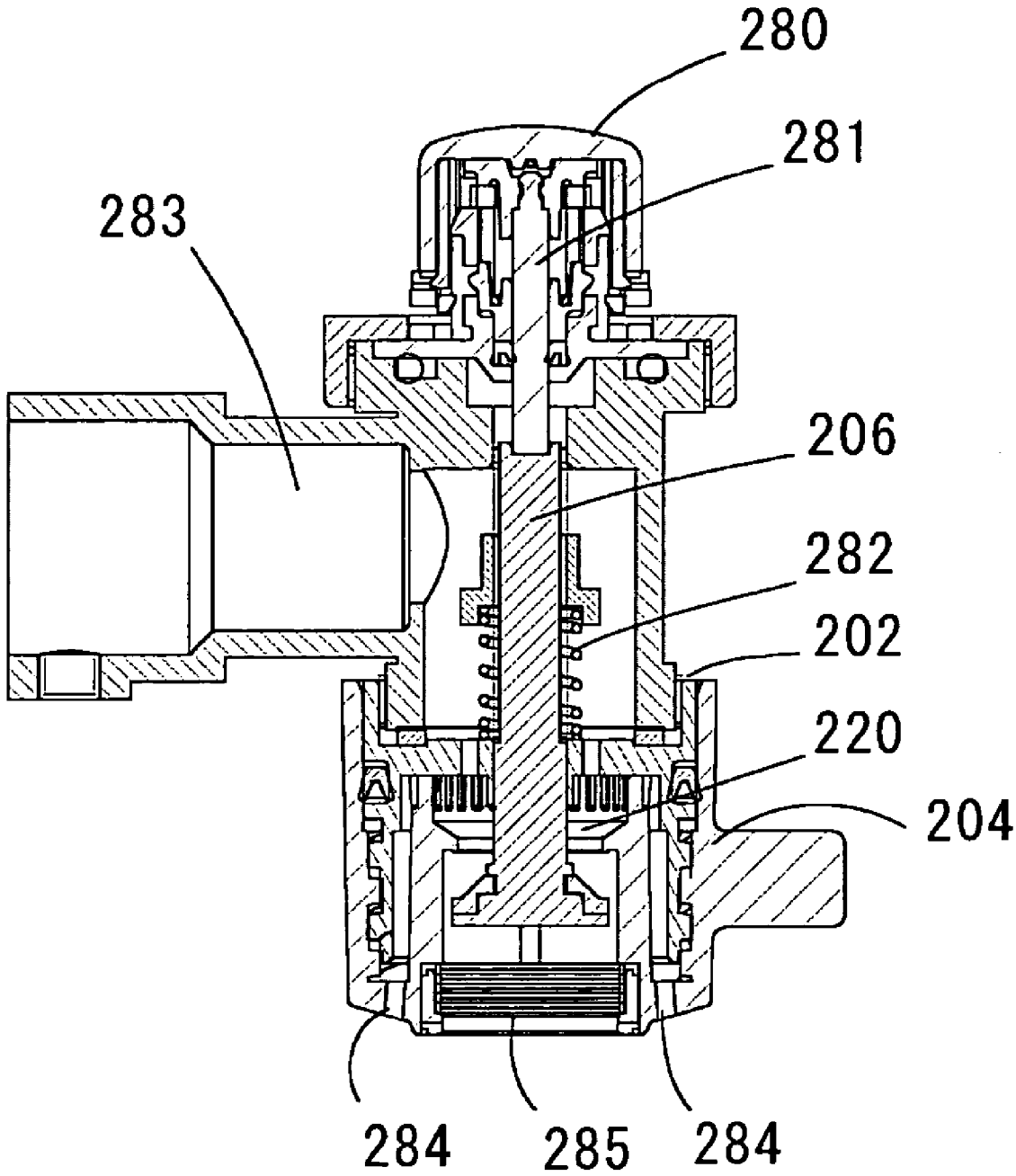
FIG. 19 is a cross-sectional view of the water discharge switching device in accordance with the seventh embodiment of the present invention and is a view showing a state where foaming water is discharged.

FIG. 19 shows a state in which the switching button 280 is pressed in and in which the switching bar 281 presses the flange-shaped valve seat 206 from above to separate the downstream outer peripheral portion of the flange-shaped valve seat 206 from the annular valve body 220 of the second cylindrical body 204. Thus, in this case, water flowing through the water inlet 283 flows out through a foaming water outlet 285 and is brought into a state of discharging the foaming water.

In this manner, the switching bar 281 is moved up and down with the operation of the switching button 280 to move up and down the flange-shaped valve seat 206 to thereby switch the water discharge.

Figure 20:
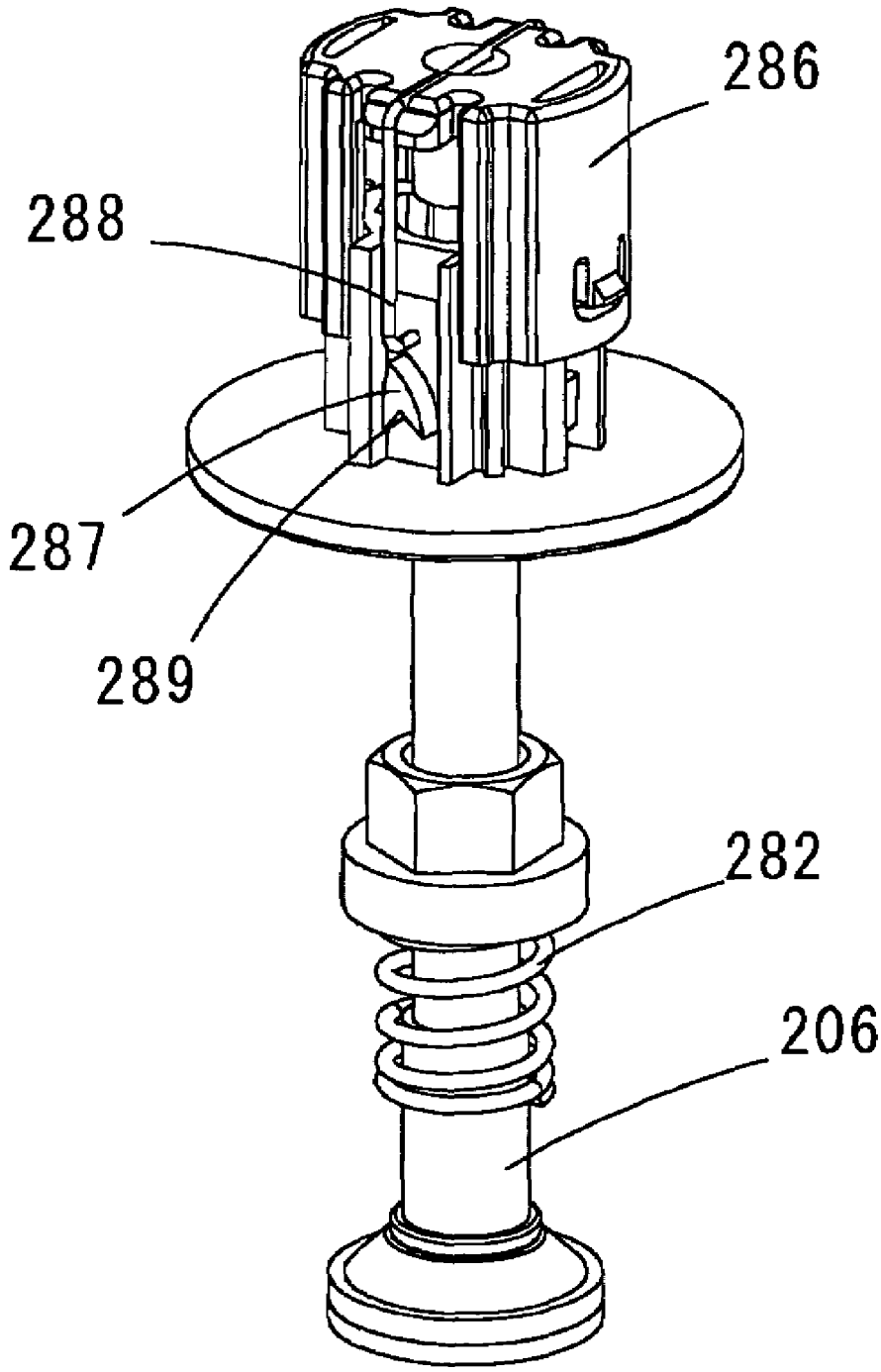
FIG. 20 is a perspective view of a mechanism in the water discharge switching device in accordance with the seventh embodiment of the present invention.
Figure 21:
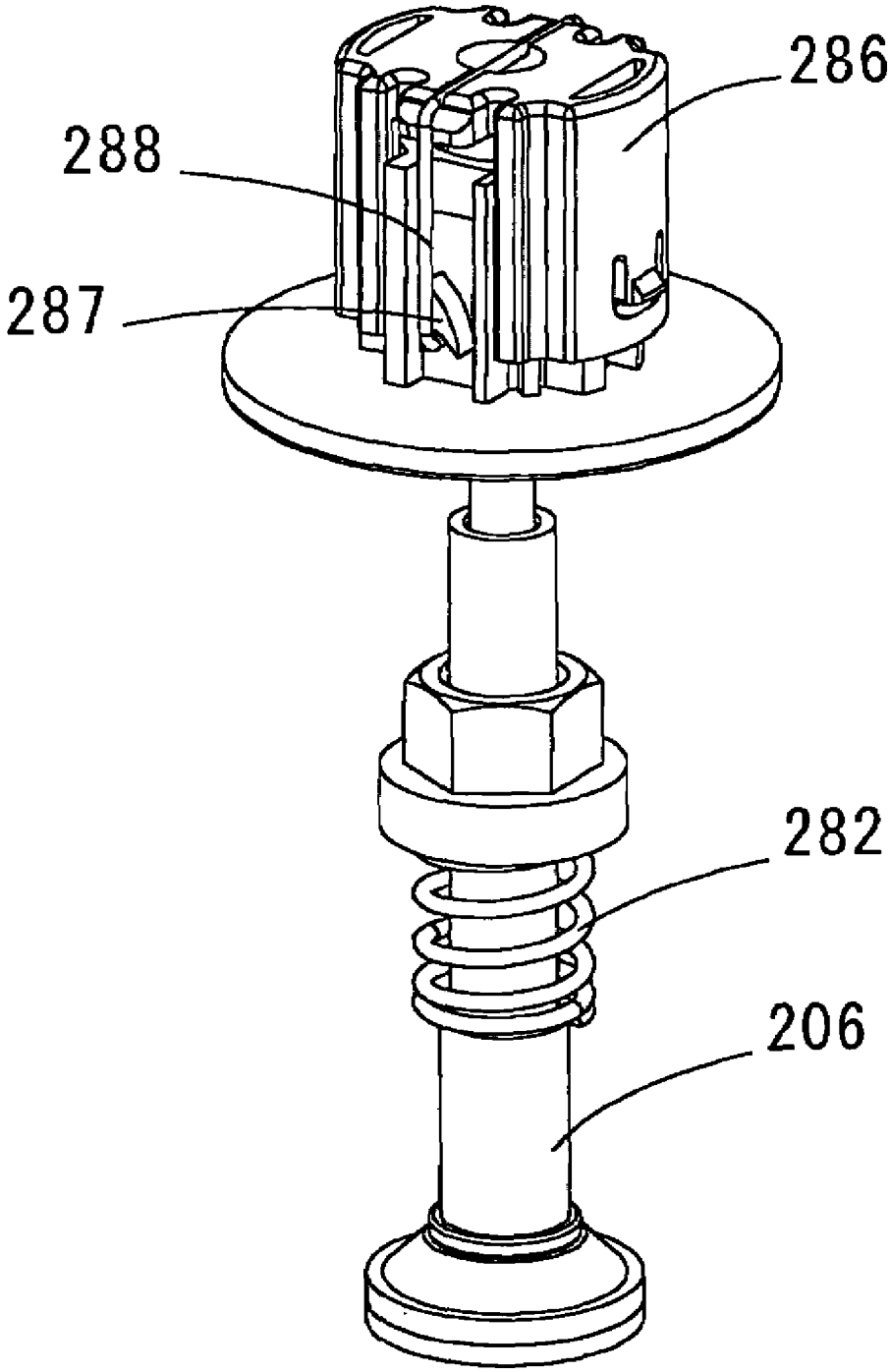
FIG. 21 is a perspective view of a mechanism in the water discharge switching device in accordance with the seventh embodiment of the present invention.

In this embodiment, the water discharge described in FIG. 18 and FIG. 19 is switched by the use of the mechanism shown in FIG. 20 and FIG. 21. FIG. 20 shows a state where the shower water is discharged, shown in FIG. 18, in which a pressing bar 288 abuts against the top portion of a heart-shaped cam 287 mounted on a switching button unit 286 and having a depression 289.

FIG. 21 shows a state of discharging the foaming water, shown in FIG. 19, in which when the switching button unit 286 is pressed downward, the bottom end of the pressing bar 288 slides along the cam 287 and abuts against the depression 289 of the cam 287 and the pressing bar 288 stops and in conjunction with this motion, the flange-shaped valve seat 206 moves down to switch the water discharge. At this time, the spring 282 is contracted further than in the state shown in FIG. 20.

When the switching button unit 286 is again pressed in, the bottom end of the pressing bar 288 slides on the side opposite to the cam 287 and is returned to the state shown in FIG. 20 by the restoring force of the spring 282. In this manner, when the water discharge is switched, it is possible for an operator to sense a click by the use of the heart-shaped cam 287.

According to this embodiment, the operation of switching the water discharge can be performed by the switching button 280 and thus operability can be improved. Moreover, the water discharge can be switched without touching the second cylindrical body 204 in which warm water and the like flows. This can prevent the occurrence of scald and thus improve safety and is preferable from the viewpoint of sanitation.

A water discharge switching device in accordance with an eighth embodiment of the invention will be described.

The embodiment in which operability in switching the water discharge is improved will be described based on FIG. 22.

FIG. 22A is a perspective view showing a state where the flange-shaped valve seat 206 is arranged in the second cylindrical body 204 and FIG. 22B is its cross-sectional view.

Figure 22:
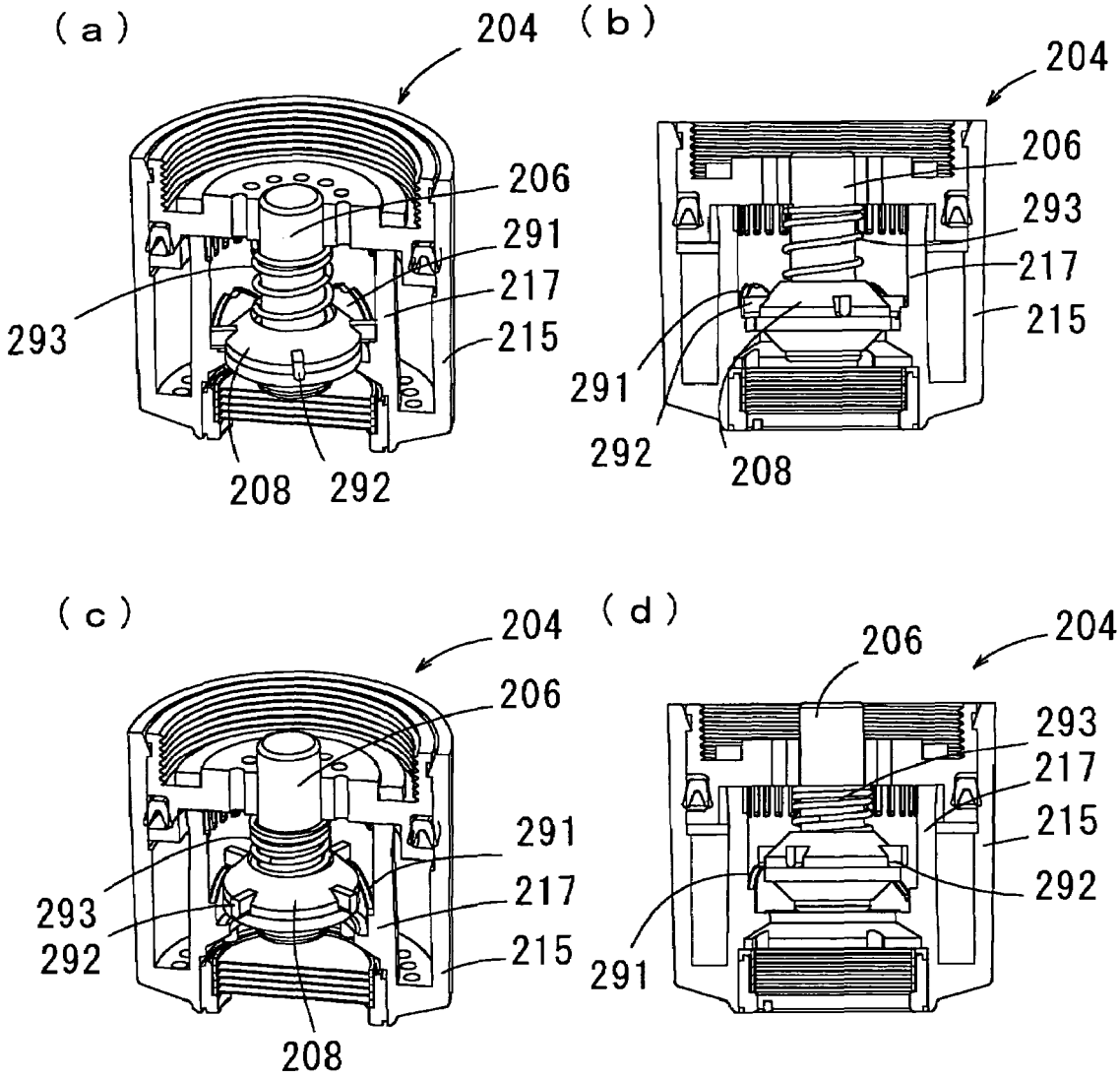
FIGS. 22A–22D are views showing a construction of a water discharge switching device in accordance with an eighth embodiment of the present invention in which operability in switching water discharge is improved.

In FIG. 22, on the inner lower side of the inner cylinder 217 of the second cylindrical body 204, provided is a cam 291 having peaks and valleys formed at regular intervals along the circumferential direction of the inner cylinder 217.

A plurality of protrusions 292 protruding in the radial direction are provided on the outer peripheral portion of the flange portion 208 of the flange-shaped valve seat 206.

When the outer cylinder 215 of the second cylindrical body 204 is turned, the cam 291 turns with the turn of the second cylindrical body 204 and slides on the protrusions 292 and the protrusions 292 alternately abut against the peaks and valleys of the cam 291.

FIGS. 22A and 22B show a case where the protrusions 292 abut against the valleys of the cam 291 and in which the flange-shaped valve seat 206 is positioned on a lower side to bring a state where the shower water is discharged.

FIGS. 22C and 22D show a case where the protrusions 292 abut against the peaks of the cam 291 and in which the flange-shaped valve seat 206 is positioned on an upper side to bring a state where the foaming water is discharged.

A spring 293 is provided on the outer periphery of the flange-shaped valve seat 206 and is repeatedly contracted or extended with the movement, in a vertical direction, of the flange-shaped valve seat 206.

In this embodiment, there are provided four protrusions 292, and four peaks and four valleys of the cam 291. For this reason, every the second cylindrical body 204 is turned 45°, the state of discharging water can be switched. Here, the number of the protrusions 292 and the number of peaks and valleys of the cam 291 are only one example, and it is not intended to limit the number to four but the number can be suitably changed according to the circumstances of use.

According to this embodiment, only by turning the second cylindrical body 204 in the circumferential direction, it is possible to alternately continuously switch between the discharge of the foaming water and the discharge of the shower water and the water discharge can be switched even if the turning direction is in either of two directions, so operability can be improved. Moreover, a stepped portion is not produced between the first cylindrical body and the second cylindrical body when the water discharge is switched and thus dust does not accumulate on this stepped portion.

A water discharge switching device in accordance with a ninth embodiment of the invention will be described.

This is a water discharge switching device relating to an embodiment in which the water discharge switching device is fitted on a new faucet or an existing faucet.

Figure 23:
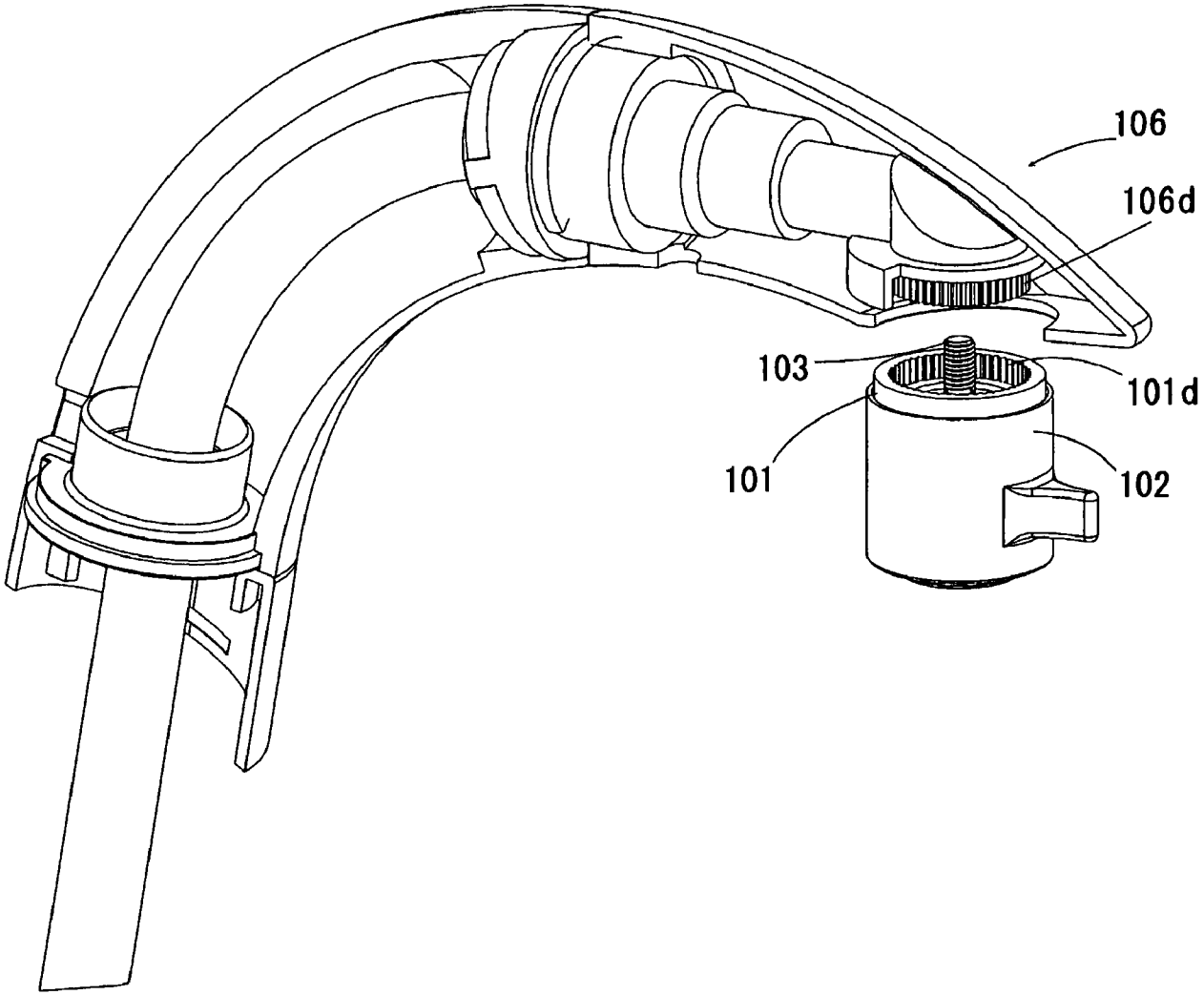
FIG. 23 is a view showing a state where a spline portion of a water discharge switching device in accordance with a ninth embodiment of the present invention is fitted on a spline portion of a faucet hardware unit.

In the water discharge switching device of this embodiment, as shown in FIG. 23, a spline portion 101*d* is formed on a first cylindrical body 101 and this spline portion 101*d* is fitted on the spline portion 106*d* of a faucet hardware unit 106. A second cylindrical body 102 is provisionally fixed to the first cylindrical body 101 fitted on the faucet hardware unit 106 via the respective spline portions in this manner, and then the first cylindrical body 101 and the second cylindrical body 102 are fixed to the faucet hardware unit 106 by the screw portion formed on the tip portion of the flange-shaped valve seat 103.

Since the first cylindrical body 101 fitted on the faucet hardware unit 106 by the fitting of the respective spline portions in this manner, in a case where a directional part such as a lever is required to direct toward a predetermined position, the directional part can be easily positioned by adjusting the fitting position of the spline portions.

Moreover, in this water discharge switching device, a state of water discharge is switched by turning the second cylindrical body 102 with respect to first cylindrical body 101, and by the use of the fitting of the spline portions. Therefore, when the second cylindrical body 102 is turned at the time when the water discharge is switched, the spline portions receive turning torque, so that it does not happen that the fitting portion is loosened, as is the case with conventional fittings that use a screw type fitting.

Further, in the water discharge switching device in which the shower water discharge ports of the shower water discharging means forms the air suction ports of the foaming water discharging means, as the water discharge switching device is miniaturized, the diameter of the screw portion of the flange-shaped valve seat for fixing can not be enlarged. However, the spline portion receives the turning torque at the time of the turning operation, so that it is possible to eliminate a load of the turning torque applied to the screw portion of the flange-shaped valve seat. For this reason, even if the diameter of the screw portion of the flange-shaped valve seat is small, it is possible to smoothly perform the turning operation and to prevent the flange-shaped valve seat from being broken or loosened.

Figure 24:
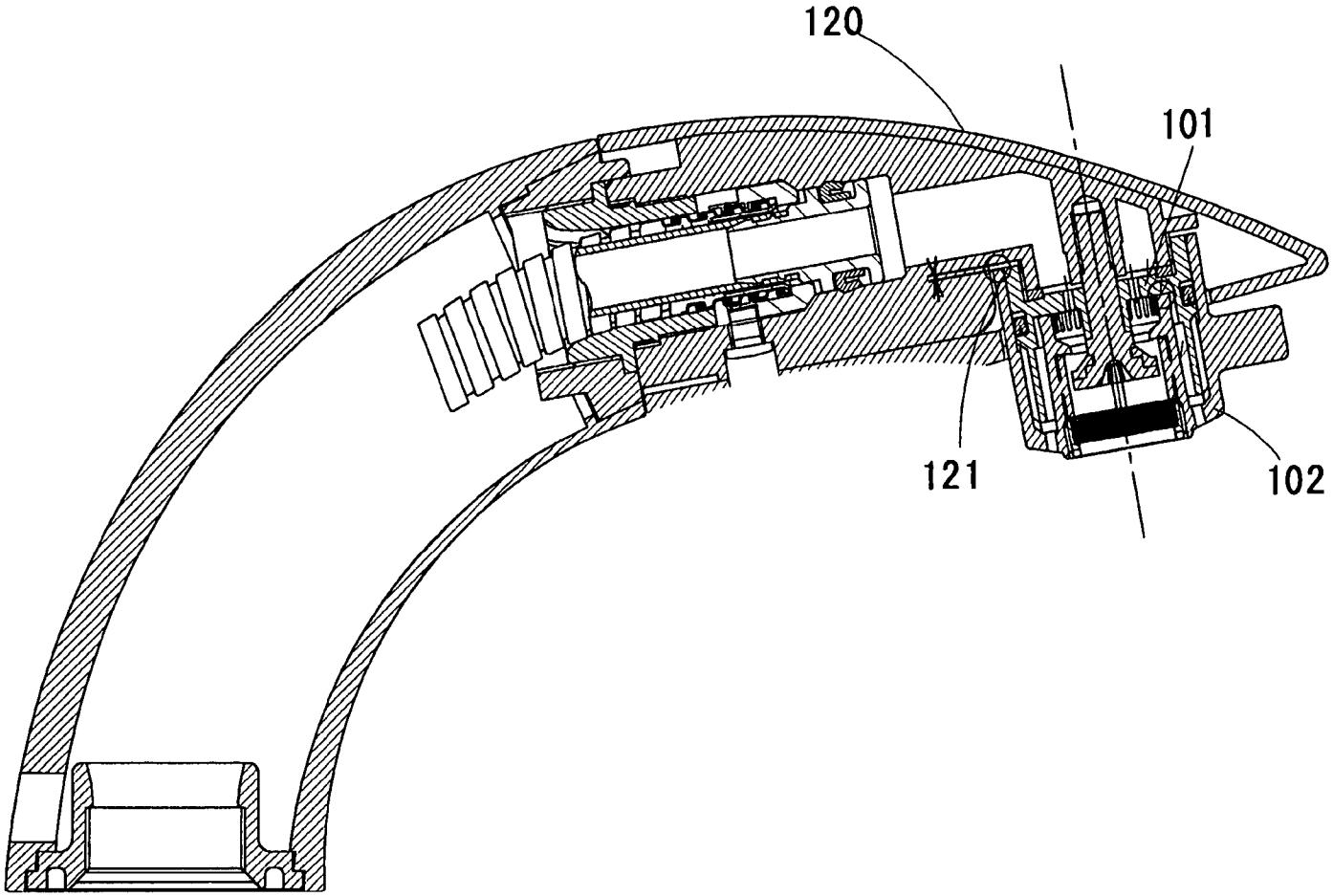
FIG. 24 is a cross-sectional view showing a state where the water discharge switching device in accordance with the ninth embodiment of the present invention is fixed to a spout body at the time when foaming water is discharged.
Figure 25:
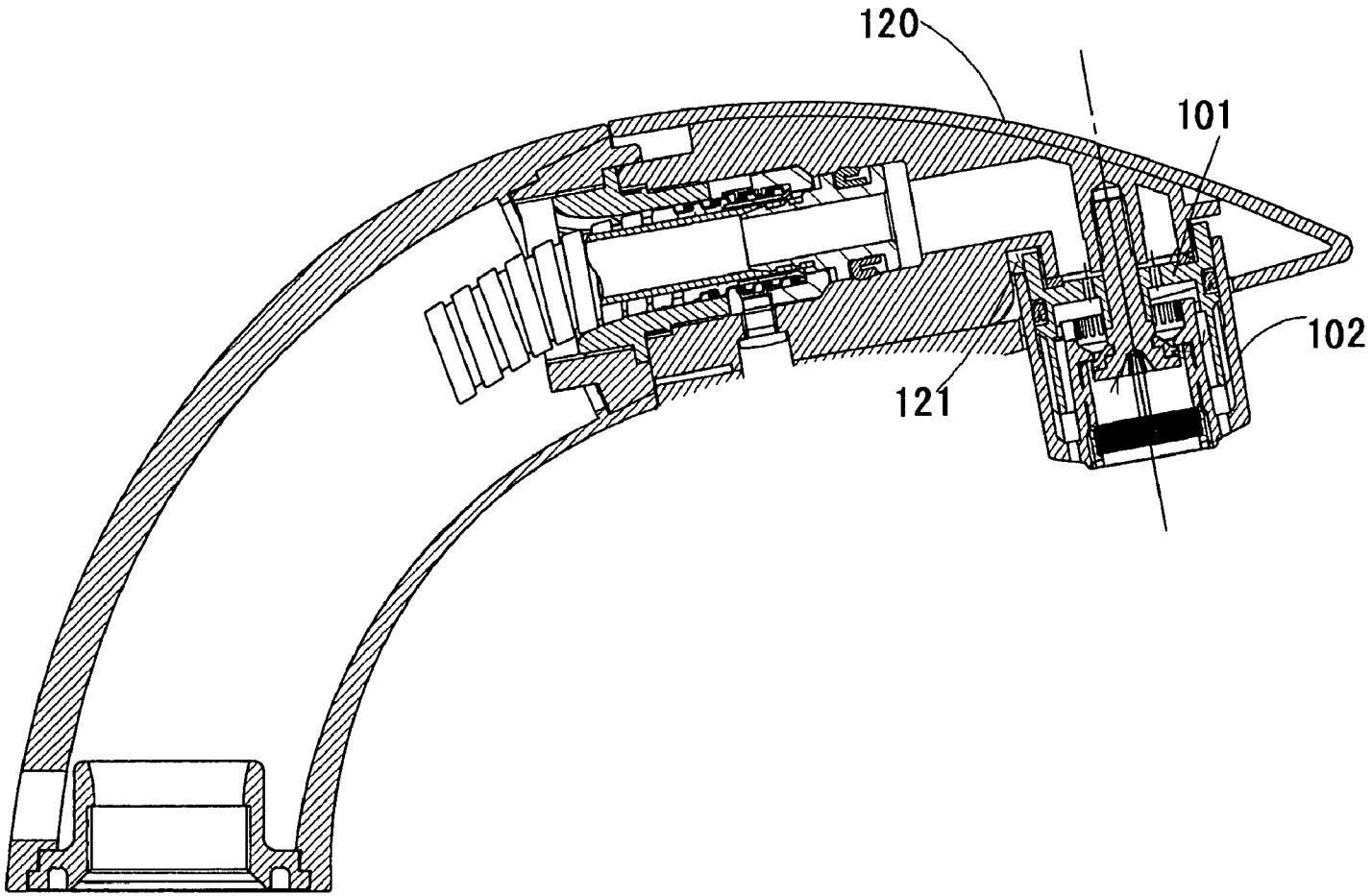
FIG. 25 is a cross-sectional view showing a state where the water discharge switching device in accordance with the ninth embodiment of the present invention is fixed to a spout body at the time when shower water is discharged.

FIG. 24 and FIG. 25 show cross sections in which the water discharge switching device is fitted on a spout body.

Of these drawings, FIG. 24 shows a state of discharging the foaming water and FIG. 25 shows a state of discharging the shower water.

As shown in FIG. 24 and FIG. 25, the water discharge switching device is fixed in a state where a part of the fitting side of the first cylindrical body 101 and the second cylindrical body 102 constituting the water discharge switching device is buried in a spout body 120. For this reason, a gap portion 121 produced between the spout body 120 and the water discharge switching device is buried in the spout body 120 and is not exposed outside, which can realize a preferable embodiment from outward appearances.

Moreover, as shown in FIG. 25, when the shower water is discharged, the second cylindrical body 102 is positioned below the first cylindrical body 101 and the tip portion of the first cylindrical body 101 is exposed with respect to the second cylindrical body 102, but this tip portion is covered by the spout body 120. Thus, this is not only preferable from outward appearances but also can prevent the dust from adhering to the surface of the first cylindrical body 101.

Figure 26:
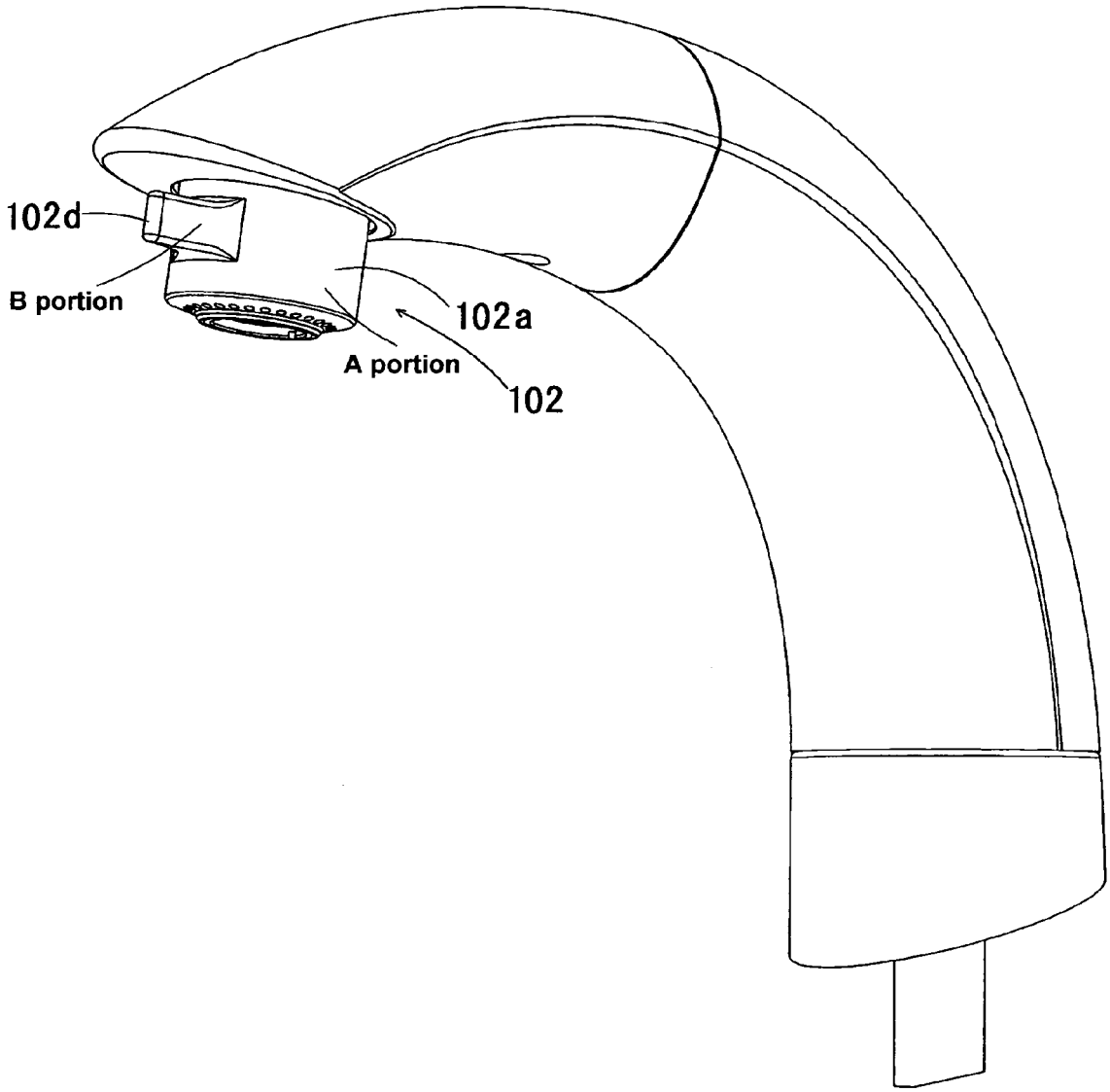
FIG. 26 is a view showing an outward appearance of the water discharge switching device in accordance with the ninth embodiment of the present invention in a state where it is fixed to a spout body.

In FIG. 26 is shown the outward appearance when the water discharge switching device of the invention is fitted on the spout body. In this water discharge switching device, a lever 102*d* is provided on a part of the outer cylinder 102*a* of the second cylindrical body 102 and the second cylindrical body 102 is turned with respect to the first cylindrical body 101 by the use of this lever 102*d* to switch a state of discharging water.

Figure 27:
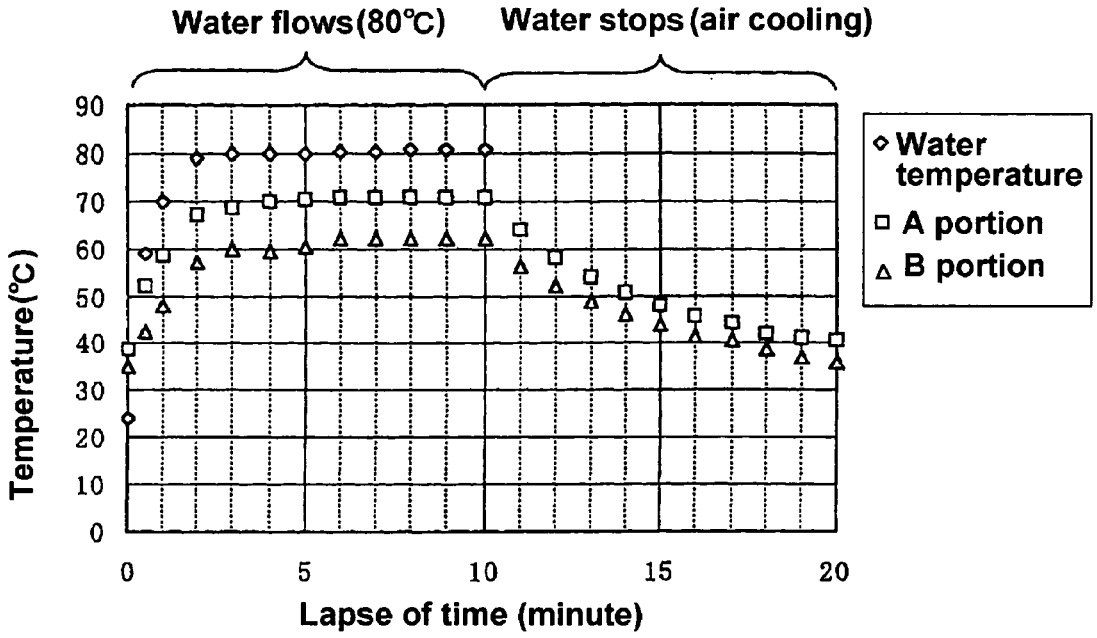
FIG. 27 is a view showing a temperature on the surface of a cylindrical body and a temperature of a lever of the water discharge switching device in accordance with the ninth embodiment of the present invention at the time when warm water is discharged.

Assuming that the surface of the second cylindrical body 102 is an A portion and the lever 102*d* is a B portion when warm water is discharged, a temperature change at these portions when warm water having a temperature of 80° C. is discharged as foaming water for 10 minutes and then is stopped to cool the water discharge switching device is shown in FIG. 27. As is clear from FIG. 27, the temperature at the B portion is always lower than that at the A portion and thus by providing the lever 102*d* formed in a manner protruding from the surface of the second cylindrical body 102, when the warm water is discharged, scalding can be prevented, so that it is possible to improve not only operability but also safety.

Figure 28:
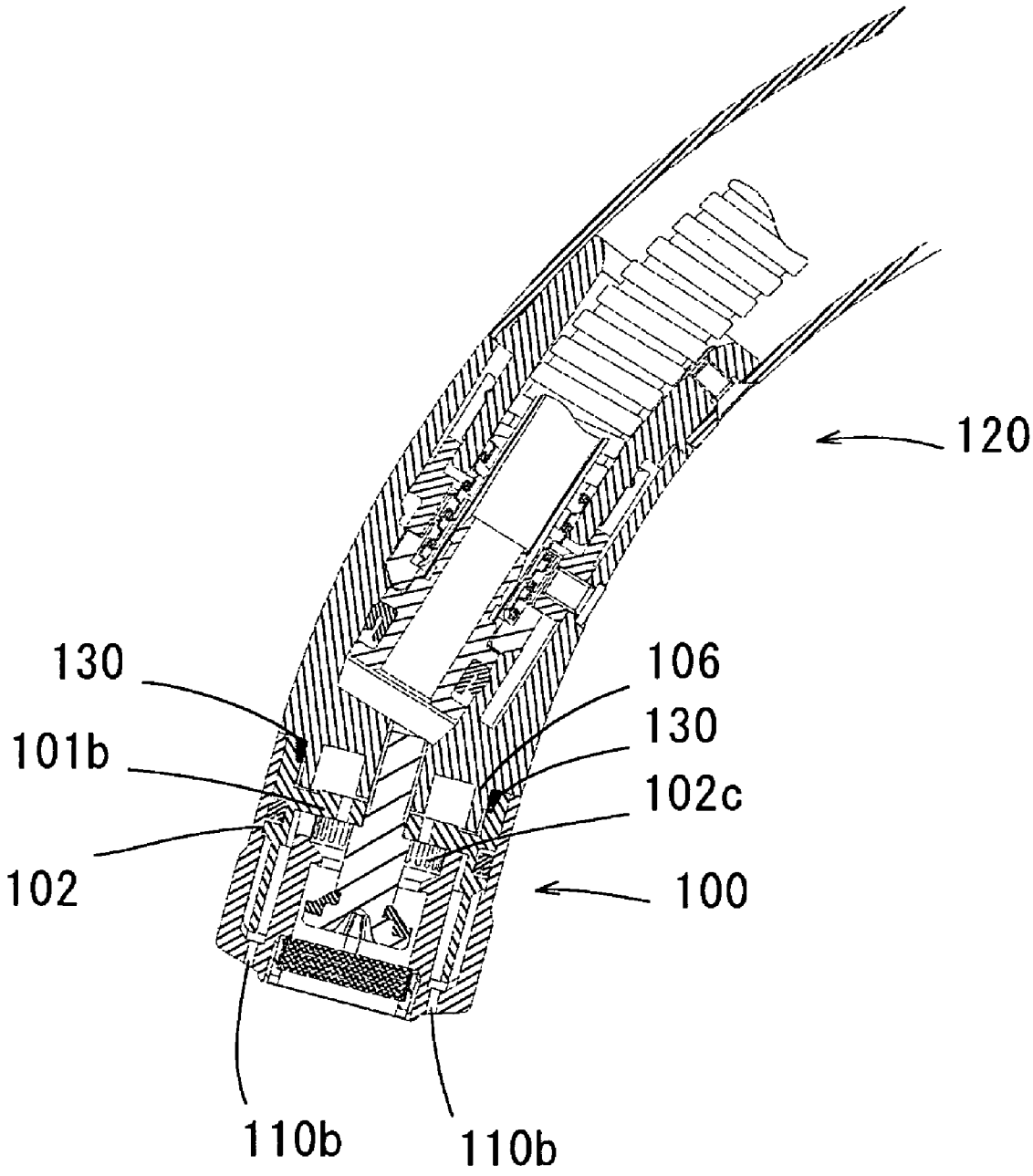
FIG. 28 is a view showing an example in which, in the water discharge switching device in accordance with the ninth embodiment of the present invention, a connection portion is packed with an O-ring.

FIG. 28 shows another embodiment when the water discharge switching device 100 is fitted on the spout body 120.

The water discharge switching device 100 is formed by screwing the first cylindrical body 101 into the second cylindrical body 102. As described in the third embodiment, in order to prevent a water leakage caused by passing water through the air suction port 110*b* side at the time when the foaming water is discharged, the top end surface of the top end slit portion 102*c* abuts against the bottom surface of the partition wall 101*b* of the first cylindrical body 101 without providing a gap therebetween.

At this time, as shown in FIG. 6, it is possible to seal a gap produced in a connection portion between the water discharge switching device 100 and the faucet hardware unit 106 by the use of the flat packing 104. However, because of an error in manufacturing the flat packing 104 and a variation in fastening strength, a gap tends to be produced in the connection portion between the top ends of the first cylindrical body 101 and the second cylindrical body 102 and the faucet hardware unit 106. For this reason, in this embodiment, the gap of the connection portion between the top ends of the first cylindrical body 101 and the second cylindrical body 102 and the faucet hardware unit 106 is packed with an O-ring 130.

The O-ring 130 is easily deformed not only in the direction in which it is pressed but also in the direction perpendicular to this direction, so that the gap of the connection portion between the top ends of the first cylindrical body 101 and the second cylindrical body 102 and the faucet hardware unit 106 can be sufficiently packed with the O-ring.

For this reason, it is possible to prevent a water leak caused by passing water through the air suction port 110*b* at the time when the foaming water is discharged and, at the same time, to pack the gap of the connection portion produced between the water discharge switching device 100 and the faucet hardware unit 106 when the water discharge switching device 100 is fitted on the faucet hardware unit 106 to prevent the dust from accumulating on the connection portion, and to produce a mode with preferable outward appearances.

As described above, the water discharge switching device in accordance with the present invention can be mounted on a new faucet or an existing faucet and is switched for use between the discharge of the foaming water and the discharge of the shower water.

Moreover, the water discharge switching device in accordance with the present invention can be fixed by screwing, and thus is afterward mounted on the existing faucet and can be switched for use between the discharge of the foaming water and the discharge of the shower water.

The invention claimed is:

1. A water discharge switching device mounted to a distal end of a faucet body, the water discharge switching device comprising:

foaming water producing and discharging means having a water inlet, an air/water mixing chamber facing to the water inlet and capable of communicating with the water inlet, an air suction port capable of communicating with the air/water mixing chamber, and a foaming water outlet;

shower water discharging means having a shower water discharge port and capable of communicating with the water inlet, the shower water discharging means being arranged around the air/water mixing chamber of the foaming water producing and discharging means; and water discharge switching means for selectively switching between discharge of foaming water from the foaming water producing and discharging means and discharge of shower water from the shower water discharging means, wherein the shower water discharge port of the shower water discharging means forms the air suction port of the foaming water producing and discharging means, and the water discharge switching means is means for opening and closing a communication passage between the air/water mixing chamber and the foaming water outlet of the foaming water producing and discharging means and is provided with flow adjusting means for adjusting a foaming water discharge flow and a shower water discharge flow, and wherein the flow adjusting means is means for adjusting a cross-sectional area of a communication passage between the air/water mixing chamber and the water inlet of the foaming water producing and discharging means and a cross-sectional area of a communication passage between the shower water discharge port of the shower water discharging means and the water inlet.

2. A water discharge switching device according to claim 1, wherein the cross-sectional area of the communication passage between the air/water mixing chamber and the water inlet of the foaming water producing and discharging means and the cross-sectional area of the communication passage between the shower water discharge port of the shower water discharging means and the water inlet are adjusted by relatively moving the shower water discharging means with respect to the air/water mixing chamber of the foaming water producing and discharging means.

3. A water discharge switching device comprising:

foaming water producing and discharging means having a water inlet, an air/water mixing chamber facing the water inlet and capable of communicating with the water inlet, an air suction port capable of communicating with the air/water mixing chamber, and a foaming water outlet;

shower water discharging means having a shower water discharge port and capable of communicating with the water inlet, the shower water discharging means being arranged around the air/water mixing chamber of the foaming water producing and discharging means; and water discharge switching means for selectively switching between discharge of foaming water from the foaming water producing and discharging means and discharge of shower water from the shower water discharging means, wherein the shower water discharge port of the shower water discharging means forms the air suction port of the foaming water producing and discharging means, the water discharge switching means is means for opening and closing a communication passage between the air/water mixing chamber and the foaming water outlet of the foaming water producing and discharging means, and the shower water discharging means is relatively moved with respect to the air/water mixing chamber of the foaming water producing and discharging means so that a communication passage between the air/water mixing chamber and the foaming water outlet of the foaming water producing and discharging means is opened and closed, the water discharge switching device further comprising: a first cylindrical body having a partition wall for defining an inflow chamber and a discharge chamber which are adjacent to each other in a vertical direction, a pillar-shaped body extending from the partition wall to form the discharge chamber in an annular shape and having a flange-shaped valve seat formed at an end portion thereof, and a plurality of first small-diameter holes formed in the partition wall in a manner surrounding the pillar-shaped body near the pillar-shaped body; and a second cylindrical body having an inner cylinder and an outer cylinder which are concentrically arranged, an end wall for closing one end of a first annular gap formed between the inner cylinder and the outer cylinder, a plurality of shower water discharge ports formed in the end wall with a gap between them in a circumferential direction, and an annular valve body extending from an inner peripheral surface of the inner cylinder, the outer cylinder of the second cylindrical body being externally fitted on the first cylindrical body in such a way that the second cylindrical body can move relatively in a vertical direction and a fitting portion thereof being sealed, the inner cylinder of the second cylindrical body moving into the discharge chamber of the first cylindrical body outside in a radial direction of the first small-diameter hole to form a second annular gap between the inner cylinder and a peripheral wall of the first cylindrical body forming an outer peripheral wall of the discharge chamber and a third annular gap between the inner cylinder and the pillar-shaped body, and the annular valve body facing to the flange-shaped valve seat in the third annular gap, and a part of the outer cylinder of the second cylindrical body being screwed on a part of the first cylindrical body.

4. A water discharge switching device according to claim 3, wherein a first screw portion which is a screw portion of a part of the flange-shaped valve seat and the partition wall of the first cylindrical body are concentrically arranged with a second screw portion which is a screw portion of a part of the outer cylinder of the second cylindrical body and a part of the first cylindrical body, and a turning direction when the first screw portion is fastened is opposite to a turning direction when the second screw portion is fastened.

5. A water discharge switching device according to claim 4, wherein a sealing member having elasticity and being watertight is provided on a side surface on an upstream side of a flange portion of the flange-shaped valve seat.

6. A water discharge switching device according to claim 3, wherein the first cylindrical body is provided with a stopper against which the second cylindrical body is made to abut from a direction of flow, thereby being stopped, and wherein the first cylindrical body has a protrusion, over which a crest of screw thread of the second cylindrical body can climb, on a bottom of the screw thread thereof.

7. A water discharge switching device according to claim 3, wherein the first cylindrical body has a non-threaded portion continuing to a notch of the first cylindrical body on an outer peripheral portion thereof.

8. A water discharge switching device according to claim 3, wherein an end portion of the first cylindrical body, on which the flange-shaped valve seat of the pillar-shaped body is formed, is formed separately from a remaining part of the first cylindrical body and is fixed to a base portion of the pillar-shaped body, and the end portion is formed of an elastomer material.

9. A water discharge switching device according to claim 3, wherein the first cylindrical body and the second cylindrical body are provided with protrusions which can climb over to each other.

10. A water discharge switching device according to claim 3, further comprising means for reducing an area of a water flow passage from the air/water mixing chamber to the air suction port in order to prevent water from flowing from the air/water mixing chamber to the air suction port at the time when foaming water is discharged.

11. A water discharge switching device according to claim 10, wherein a top end slit portion provided in the second cylindrical body is formed in a shape of a fin, and a top end surface of the top end slip portion is made to abut against a bottom surface of the partition wall of the first cylindrical body to reduce the area of the water flow passage.

12. A water discharge switching device according to claim 11, wherein the top end slit portion is formed as a separate part.

13. A water discharge switching device according to claim 10, wherein a plurality of small holes are formed in a radial direction through a tip portion of the inner cylinder of the second cylindrical body and a top end surface of the tip portion of the inner cylinder is made to abut against a bottom surface of the partition wall of the first cylindrical body to reduce the area of the water flow passage.

14. A water discharge switching device according to claim 13, wherein the tip portion having the plurality of small holes is formed as a separate part.

15. A water discharge switching device comprising:

foaming water producing and discharging means having a water inlet, an air/water mixing chamber facing to the water inlet and capable of communicating with the water inlet, an air suction port capable of communicating with the air/water mixing chamber, and a foaming water outlet;

shower water discharging means having a shower water discharge port and capable of communicating with the water inlet, the shower water discharging means being arranged around the air/water mixing chamber of the foaming water producing and discharging means; and water discharge switching means for selectively switching between discharge of foaming water from the foaming water producing and discharging means and discharge of shower water from the shower water discharging means, in which the shower water discharge port of the shower water discharging means forms the air suction port of the foaming water producing and discharging means, and the water discharge switching means is means for opening and closing a communication passage between the air/water mixing chamber and the foaming water outlet of the foaming water producing and discharging means, the water discharge switching device further comprising: a first cylindrical body having a partition wall for defining an inflow chamber and a discharge chamber which are adjacent to each other in a longitudinal direction, a pillar-shaped body extending from the partition wall to form the discharge chamber in an annular shape and having a flange-shaped valve seat formed at an end portion thereof, and a plurality of first small-diameter holes formed in the partition wall in a manner surrounding the pillar-shaped body near the pillar-shaped body; and a second cylindrical body having an inner cylinder and an outer cylinder which are concentrically arranged, an end wall for closing one end of a first annular gap formed between the inner cylinder and the outer cylinder, a plurality of shower water discharge ports formed in the end wall with a gap between them in a circumferential direction, and an annular valve body extending from an inner peripheral surface of the inner cylinder, the outer cylinder of the second cylindrical body being externally fitted on the first cylindrical body such that the second cylindrical body can move relatively in a vertical direction and a fitting portion thereof being sealed, the inner cylinder of the second cylindrical body moving into the discharge chamber of the first cylindrical body outside in a radial direction of the first small-diameter hole to form a second annular gap between the inner cylinder and a peripheral wall of the first cylindrical body forming an outer peripheral wall of the discharge chamber and a third annular gap between the inner cylinder and the pillar-shaped body, and the annular valve body facing the flange-shaped valve seat in the third annular gap, wherein a predetermined region in a circumferential direction of an outer surface of the end wall is inclined from the inner cylinder to the outer cylinder in a direction closer to an open end of the first annular gap, and a remaining region in the circumferential direction of the outer surface of the end wall is perpendicular to the shower water discharge ports.

16. A water discharge switching device comprising:

foaming water producing and discharging means having a water inlet, an air/water mixing chamber facing the water inlet and capable of communicating with the water inlet, an air suction port capable of communicating with the air/water mixing chamber, and a foaming water outlet;

shower water discharging means having a shower water discharge port and capable of communicating with the water inlet, the shower water discharging means being arranged around the air/water mixing chamber of the foaming water producing and discharging means; and water discharge switching means for selectively switching between discharge of foaming water from the foaming water producing and discharging means and discharge of shower water from the shower water discharging means, in which the shower water discharge port of the shower water discharging means forms the air suction port of the foaming water producing and discharging means, and the water discharge switching means is means for opening and closing a communication passage between the air/water mixing chamber and the foaming water outlet of the foaming water producing and discharging means, the water discharge switching device further comprising: a first cylindrical body having a partition wall for defining an inflow chamber and a discharge chamber which are adjacent to each other in a vertical direction, a pillar-shaped body extending from the partition wall to form the discharge chamber in an annular shape and having a flange-shaped valve seat formed at an end portion thereof, and a plurality of first small-diameter holes formed in the partition wall in a manner surrounding the pillar-shaped body near the pillar-shaped body; and a second cylindrical body having an inner cylinder and an outer cylinder which are concentrically arranged, an end wall for closing one end of a first annular gap formed between the inner cylinder and the outer cylinder, a plurality of shower water discharge ports formed in the end wall with a gap between them in a circumferential direction, and an annular valve body extending from an inner peripheral surface of the inner cylinder, the outer cylinder of the second cylindrical body being externally fitted on the first cylindrical body such that it can move relatively in a vertical direction and a fitting portion thereof being sealed, the inner cylinder of the second cylindrical body moving into the discharge chamber of the first cylindrical body outside in a radial direction of the first small-diameter hole to form a second annular gap between the inner cylinder and a peripheral wall of the first cylindrical body forming an outer peripheral wall of the discharge chamber and a third annular gap between the inner cylinder and the pillar-shaped body, and the annular valve body facing to the flange-shaped valve seat in the third annular gap, wherein the plurality of shower water discharge ports are arranged in a manner of a plurality of concentric circles having different diameters and an angle formed by a direction in which the shower water discharge ports extend and a direction in which the inner cylinder and the outer cylinder of the second cylindrical body extend varies for each circle in which the shower water discharge ports are arranged.

17. A water discharge switching device comprising:

foaming water producing and discharging means having a water inlet, an air/water mixing chamber facing to the water inlet and capable of communicating with the water inlet, an air suction port capable of communicating with the air/water mixing chamber, and a foaming water outlet;

shower water discharging means having a shower water discharge port and capable of communicating with the water inlet, the shower water discharging means being arranged around the air/water mixing chamber of the foaming water producing and discharging means; and water discharge switching means for selectively switching between discharge of foaming water from the foaming water producing and discharging means and discharge of shower water from the shower water discharging means, wherein the shower water discharge port of the shower water discharging means forms the air suction port of the foaming water producing and discharging means, the water discharge switching means is means for opening and closing a communication passage between the air/water mixing chamber and the foaming water outlet of the foaming water producing and discharging means, and the foaming water producing and discharging means and the shower water discharging means are formed by fitting a first cylindrical body which is an inner cylindrical body in a second cylindrical body which is an outer cylindrical body and a switching bar provided in a switching button abuts against a top end of a flange-shaped valve seat and the switching bar is moved up and down by operating the switching button to move up and down the flange-shaped valve seat to switch water discharge.

18. A water discharge switching device comprising:

foaming water producing and discharging means having a water inlet, an air/water mixing chamber facing to the water inlet and capable of communicating with the water inlet, an air suction port capable of communicating with the air/water mixing chamber, and a foaming water outlet;

shower water discharging means having a shower water discharge port and capable of communicating with the water inlet, the shower water discharging means being arranged around the air/water mixing chamber of the foaming water producing and discharging means; and water discharge switching means for selectively switching between discharge of foaming water from the foaming water producing and discharging means and discharge of shower water from the shower water discharging means, wherein the shower water discharge port of the shower water discharging means forms the air suction port of the foaming water producing and discharging means, the water discharge switching means is means for opening and closing a communication passage between the air/water mixing chamber and the foaming water outlet of the foaming water producing and discharging means, the foaming water producing and discharging means and the shower water discharging means are formed by fitting a first cylindrical body which is an inner cylindrical body in a second cylindrical body which is an outer cylindrical body, a cam having peaks and valleys formed at regular intervals along a circumferential direction of the inner cylinder is provided on an inner lower side of the inner cylinder of the second cylindrical body, a plurality of protrusions protruding in a radial direction are provided on an outer peripheral portion of a flange portion of the flange-shaped valve seat, and the cam slides on the protrusions with a turn of the second cylindrical body to make the protrusions alternately abut against the peaks and valleys of the cam to move up and down the flange-shaped valve seat, thereby switching water discharge.

19. A water discharge switching device comprising:

foaming water producing and discharging means having a water inlet, an air/water mixing chamber facing to the water inlet and capable of communicating with the water inlet, an air suction port capable of communicating with the air/water mixing chamber, and a foaming water outlet;

shower water discharging means having a shower water discharge port and capable of communicating with the water inlet, the shower water discharging means being arranged around the air/water mixing chamber of the foaming water producing and discharging means; and water discharge switching means for selectively switching between discharge of foaming water from the foaming water producing and discharging means and discharge of shower water from the shower water discharging means, wherein the shower water discharge port of the shower water discharging means forms the air suction port of the foaming water producing and discharging means, the water discharge switching means is means for opening and closing a communication passage between the air/water mixing chamber and the foaming water outlet of the foaming water producing and discharging means, the foaming water producing and discharging means and the shower water discharging means are formed by screwing a first cylindrical body which is an inner cylindrical body in a second cylindrical body which is an outer cylindrical body, and the first cylindrical body is provided with a spline portion and the spline portion of the first cylindrical body can be fitted on a spline portion of a faucet hardware unit.

20. A water discharge switching device according to claim 19, wherein the first cylindrical body and the second cylindrical body provisionally fixed to the first cylindrical body can be fitted on the faucet hardware unit by a flange-shaped valve seat.

21. A water discharge switching device comprising:

foaming water producing and discharging means having a water inlet, an air/water mixing chamber facing to the water inlet and capable of communicating with the water inlet, an air suction port capable of communicating with the air/water mixing chamber, and a foaming water outlet;

shower water discharging means having a shower water discharge port and capable of communicating with the water inlet, the shower water discharging means being arranged around the air/water mixing chamber of the foaming water producing and discharging means; and water discharge switching means for selectively switching between discharge of foaming water from the foaming water producing and discharging means and discharge of shower water from the shower water discharging means, wherein the shower water discharging port of the shower water discharging means forms the air suction port of the foaming water producing and discharging means, the water discharge switching means is means for opening and closing a communication passage between the air/water mixing chamber and the foaming water outlet of the foaming water producing and discharging means, the foaming water producing and discharging means and the shower water discharging means are formed by screwing a first cylindrical body which is an inner cylindrical body in a second cylindrical body which is an outer cylindrical body, and a part, on a side fitted to a faucet hardware unit, of the first cylindrical body and the second cylindrical body is fixed to a spout body so as to be buried therein.

* * * * *